US008071833B2

(12) United States Patent
Grootjans et al.

(10) Patent No.: US 8,071,833 B2
(45) Date of Patent: Dec. 6, 2011

(54) PRODUCTION OF OLEFINS

(75) Inventors: Jacques Grootjans, Leefdael (BE); Valérie Vanrysselberghe, Aalbeke (BE); Walter Vermeiren, Houthalen (BE)

(73) Assignee: Total Petrochemicals Research Feluy, Seneffe (Feluy) (BE)

( * ) Notice: Subject to any disclaimer, the term of this patent is extended or adjusted under 35 U.S.C. 154(b) by 1467 days.

(21) Appl. No.: 10/515,559

(22) PCT Filed: May 22, 2003

(86) PCT No.: PCT/EP03/05444

§ 371 (c)(1),
(2), (4) Date: Aug. 11, 2005

(87) PCT Pub. No.: WO03/099964

PCT Pub. Date: Dec. 4, 2003

(65) Prior Publication Data

US 2006/0100473 A1 May 11, 2006

(30) Foreign Application Priority Data

May 23, 2002 (EP) ..... 02076994

(51) Int. Cl.
*C07C 4/02* (2006.01)

(52) U.S. Cl. ..... 585/652; 585/314; 585/315; 585/324; 585/330; 585/648; 585/651; 208/107; 208/129; 208/130

(58) Field of Classification Search ..... 585/648, 585/652, 314, 315, 324, 330, 651; 208/107, 208/129, 130

See application file for complete search history.

(56) References Cited

U.S. PATENT DOCUMENTS

| | | | | |
|---|---|---|---|---|
| 4,599,476 | A | 7/1986 | Drent | |
| 4,599,479 | A * | 7/1986 | Okamoto et al. | 585/648 |
| 5,523,502 | A | 6/1996 | Rubin | |
| 6,033,555 | A | 3/2000 | Chen et al. | |
| 6,307,117 | B1 | 10/2001 | Tsunoda et al. | |
| 6,388,161 | B1 | 5/2002 | Dath et al. | |
| 6,410,813 | B1 | 6/2002 | Dath et al. | |
| 6,977,321 | B1 | 12/2005 | Dath et al. | |
| 2001/0054571 | A1 | 12/2001 | Stuntz et al. | |

FOREIGN PATENT DOCUMENTS

| | | | |
|---|---|---|---|
| EP | 1 063 274 | A1 * | 12/2000 |
| GB | 600471 | | 4/1948 |
| GB | 733336 | | 7/1955 |
| JP | 11246870 | | 9/1999 |
| WO | 9929802 | A1 | 6/1999 |
| WO | WO 99/29802 | A1 | 6/1999 |
| WO | WO 99/41331 | A1 | 8/1999 |
| WO | 0100749 | A1 | 1/2001 |

* cited by examiner

*Primary Examiner* — Prem C Singh

(57) ABSTRACT

A process (or steam cracking a hydrocarbon feedstock containing olefins to provide increased light olefins in the steam cracked effluent, the process comprising passing a first hydrocarbon feedstock containing one or more olefins through a reactor containing a crystalline silicate to produce an intermediate effluent with an olefin content of lower molecular weight than that of the feedstock, fractionating the intermediate effluent to provide a lower carbon fraction and a higher carbon fraction, and passing the higher carbon fraction, as a second hydrocarbon feedstock, through a stream cracker to produce a steam cracked effluent.

12 Claims, 5 Drawing Sheets

PROCESS SCHEME

PRODUCTION OF OLEFINS

Figure 1:
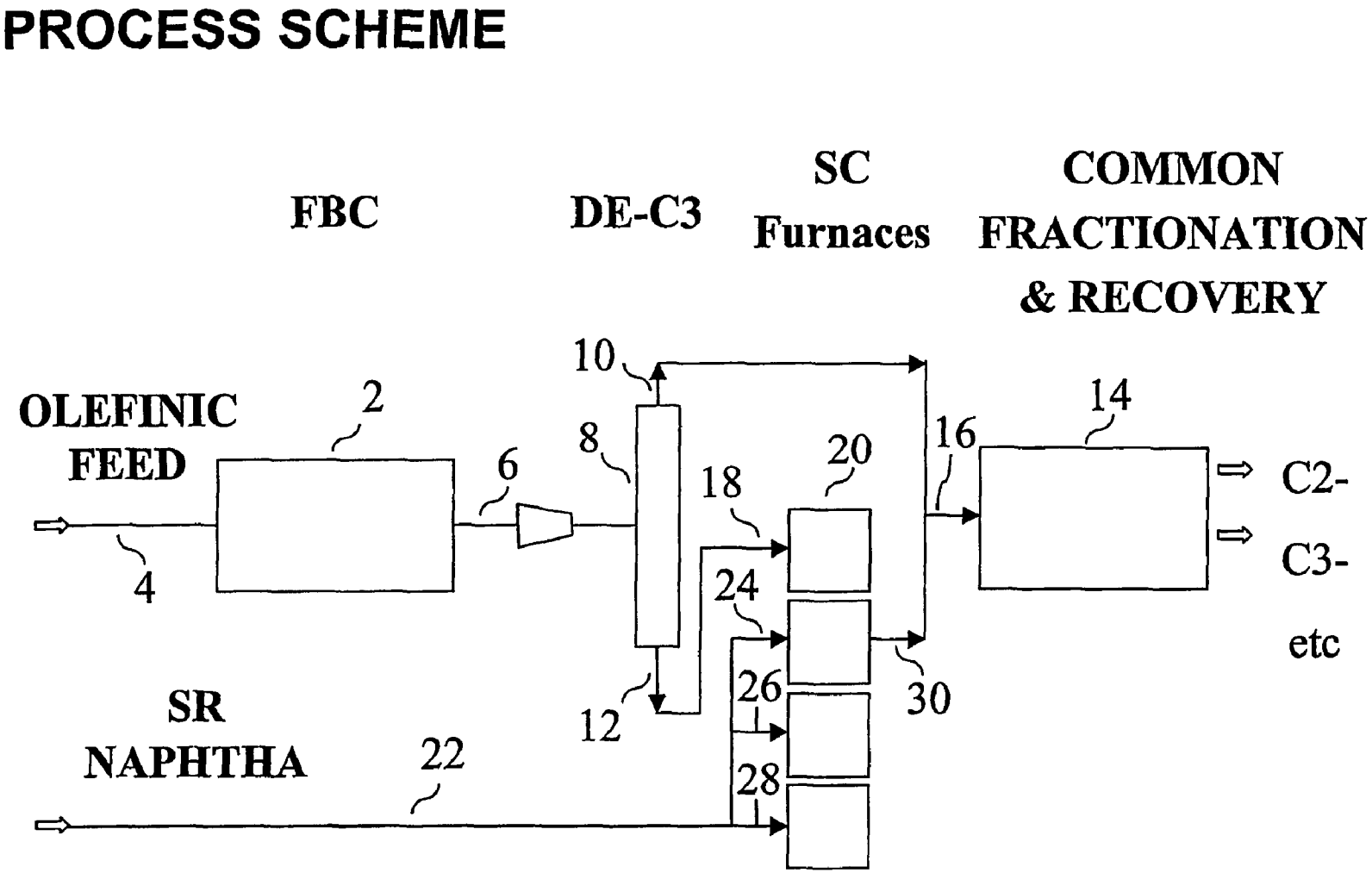

The present invention relates to a process for steam cracking a hydrocarbon feedstock to produce an effluent containing light olefins, in particular propylene. In particular, olefinic feedstocks from refineries or petrochemical plants can be converted selectively so as to redistribute the olefin content of the feedstock in the resultant effluent.

The use of steam cracking of hydrocarbon feedstocks is well known in the art. For the production of an effluent containing propylene, it is known to steam crack a feedstock comprising a straight run (SR) naphtha, which contains substantially no olefins but straight chain and isoparaffins. However, the propylene yield is quite low, and the ratio of propylene to ethylene (the lower olefins) is also quite low.

There is a need in the art to increase the production of propylene using such a steam cracker.

It is also known to crack catalytically an olefin-containing feedstock using a crystalline silicate catalyst, for example from WO-A-99/29802.

It is further known to use a crystalline silicate cracking catalyst to produce light olefins such as ethylene. For example, WO-A-98/56877 discloses a process for improving the conversion of a light hydrocarbon feedstock to light olefins comprising the steps of first contacting the hydrocarbon feedstock with a light olefin producing cracking catalyst, such as a ZSM-5 zeolite, and subsequently thermally cracking the unseparated stream to produce additional ethylene.

There is a need for a high yield propylene production method which can readily be integrated into a refinery or petrochemical plant, taking advantage of feedstocks that are less valuable for the market place (having few alternatives on the market), and which can increase the propylene production from the steam cracking of hydrocarbon feedstocks.

It is an object of the present invention to provide a process for steam cracking olefin feedstocks present in refineries and petrochemical plants which has a high conversion of olefins into lighter olefins, and in particular propylene.

It is another object of the invention to provide a process for producing propylene having a high propylene yield and purity.

It is a further object of the present invention to provide such a process which can produce olefin effluents which are within, at least, a chemical grade quality.

It is yet a further object of the present invention to provide a process for producing olefins having a stable olefinic conversion and a stable product distribution over time.

It is yet a further object of the present invention to provide a process for converting olefinic feedstocks having a high yield on an olefin basis towards propylene, irrespective of the origin and composition of the olefinic feedstock.

It is yet another object of the present invention to provide such a catalytic cracking process for olefin-containing streams whereby as a result of fractionation the fractionation products are economically useful.

The present invention provides process for steam cracking a hydrocarbon feedstock containing olefins to provide increased light olefins in the steam cracked effluent, the process comprising passing a first hydrocarbon feedstock containing one or more olefins through a reactor containing a crystalline silicate to produce an intermediate effluent with an olefin content of lower molecular weight than that of the feedstock, fractionating the intermediate effluent to provide a lower carbon fraction and a higher carbon fraction, and passing the higher carbon fraction, as a second hydrocarbon feedstock, through a steam cracker to produce a steam cracked effluent.

Preferably, the lower carbon fraction contains $C_3$ and lower hydrocarbons and the higher carbon fraction contains $C_4$ and higher hydrocarbons.

Preferably, the first hydrocarbon feedstock comprises at least one of a hydrotreated raw $C_4$ feedstock, LCCS, a raffinate 2 feedstock, a raffinate 1 feedstock, a raffinate 2 feedstock from a methyl tert-butyl ether (MTBE) or an ethyl tert-butyl ether (ETBE) unit, a raffinate from an olefins metathesis unit, in particular for the production of propylene from ethylene and butene, or a hydrotreated olefin-containing stream from an FCC unit, a visbreaker or a delayed coker.

Preferably, the effluent of the steam cracker and the lower carbon fraction are combined and the combined stream is subjected to combined fractionation.

Preferably, the steam cracker is additionally fed with a paraffin-containing hydrocarbon feedstock.

Preferably, the paraffin-containing and second hydrocarbon feedstocks are steam cracked in respective furnaces of a common steam cracker at different severity.

Preferably, the paraffin-containing hydrocarbon feedstock is a $C_5$ to $C_9$ naphtha containing straight and/or isoparaffins Preferably, the crystalline silicate is selected from an MFI-type crystalline silicate having a silicon/aluminium atomic ratio of at least 180 and an MEL-type crystalline silicate having a silicon/aluminium atomic ratio of from 150 to 800 which has been subjected to a steaming step Preferably, the first hydrocarbon feedstock is passed over the crystalline silicate at an inlet temperature of from 500 to 600° C., at an olefin partial pressure of from 0.1 to 2 bars and at an LHSV of from 5 to 30 $h^{-1}$.

Preferably, the steam cracking of the second hydrocarbon feedstock is performed in the steam cracker at an outlet coil temperature of from 760 to 860° C.

Preferably, the outlet coil temperature is around 780° C.

The present invention also provides process for steam cracking a hydrocarbon feedstock containing olefins to provide increased light olefins in the steam cracked effluent, the process comprising passing a first hydrocarbon feedstock containing one or more olefins, which comprises at least one of a hydrotreated raw $C_4$ feedstock, LCCS, a raffinate 2 feedstock, a raffinate 1 feedstock, a raffinate 2 feedstock from a methyl tert-butyl ether (MTBE) or an ethyl tert-butyl ether (ETBE) unit, a raffinate from an olefins metathesis unit, in particular for the production of propylene from ethylene and butene, or a hydrotreated olefin-containing stream from an FCC unit, a visbreaker or a delayed coker, through a reactor containing a crystalline silicate to produce an intermediate effluent with an olefin content of lower molecular weight than that of the feedstock, and passing the intermediate effluent as a second hydrocarbon feedstock through a steam cracker to produce a steam cracked effluent.

Preferably, the steam cracker is additionally fed with a paraffin-containing hydrocarbon feedstock.

Preferably, the paraffin-containing and second hydrocarbon feedstocks are steam cracked in respective furnaces of a common steam cracker at different severity.

The steam cracker may have a common outlet, thereby to produce a combined effluent.

Preferably, the paraffin-containing hydrocarbon feedstock is a $C_5$ to $C_9$ naphtha containing straight and/or isoparaffins Preferably, the crystalline silicate is selected from an MFI-type crystalline silicate having a silicon/aluminium atomic ratio of at least 180 and an MEL-type crystalline silicate having a silicon/aluminium atomic ratio of from 150 to 800 which has been subjected to a steaming step Preferably, the first hydrocarbon feedstock is passed over the crystalline silicate at an inlet temperature of from 500 to 600° C., at an olefin partial pressure of from 0.1 to 2 bars and at an LHSV of from 5 to 30 $h^{-1}$.

Preferably, the steam cracking of the second hydrocarbon feedstock is performed in the steam cracker at an outlet coil temperature of from 760 to 860° C.

Preferably, the outlet coil temperature is around 780° C.

The present invention yet further provides process for steam cracking a hydrocarbon feedstock containing olefins to provide increased light olefins in the steam cracked effluent, the process comprising steam cracking a first hydrocarbon feedstock comprising a paraffin-containing hydrocarbon feedstock and steam cracking a second hydrocarbon feedstock which contains $C_4$ and higher hydrocarbons, the second hydrocarbon feedstock containing one or more olefins and comprising a bottom fraction of an intermediate effluent produced by catalytic cracking of a third hydrocarbon feedstock in a reactor containing a crystalline silicate to produce the intermediate effluent having an olefin content of lower molecular weight than that of the third feedstock, and combining the two steam-cracked effluents to provide a common effluent.

Preferably, the third hydrocarbon feedstock comprises at least one of a hydrotreated raw $C_4$ feedstock, LCCS, a raffinate 2 feedstock, a raffinate 1 feedstock, a raffinate 2 feedstock from a methyl tert-butyl ether (MTBE) or an ethyl tert-butyl ether (ETBE) unit, a raffinate from an olefins metathesis unit, in particular for the production of propylene from ethylene and butene, or a hydrotreated olefin-containing stream from an FCC unit, a visbreaker or a delayed coker.

Preferably, the common effluent of the steam cracker and a top fraction of the intermediate effluent which contains $C_3$ and lower hydrocarbons are combined and the combined stream is subjected to combined fractionation.

Preferably, the paraffin-containing hydrocarbon feedstock is a $C_5$ to $C_9$ naphtha containing straight and/or isoparaffins Preferably, the crystalline silicate is selected from an MFI-type crystalline silicate having a silicon/aluminium atomic ratio of at least 180 and an MEL-type crystalline silicate having a silicon/aluminium atomic ratio of from 150 to 800 which has been subjected to a steaming step Preferably, the third hydrocarbon feedstock is passed over the crystalline silicate at an inlet temperature of from 500 to 600° C., at an olefin partial pressure of from 0.1 to 2 bars and at an LHSV of from 5 to 30 $h^{-1}$.

Preferably, the steam cracking of the second hydrocarbon feedstock is performed in a steam cracker having an outlet coil temperature of from 760 to 860° C.

Preferably, the outlet coil temperature is around 780° C.

Preferably, the composite feedstock for the steam cracking comprises from 5 to 95 wt % of the first hydrocarbon feedstock and from 95 to 5 wt % of the second hydrocarbon feedstock.

Preferably, the first and second hydrocarbon feedstocks are steam cracked in respective furnaces of a common steam cracker at different severity.

The present invention can thus provide a process wherein olefin-rich hydrocarbon streams (products) from refinery and petrochemical plants are selectively cracked not only into light olefins, but particularly into propylene.

The feedstock may be fed either undiluted or diluted with an inert gas such as nitrogen. In the latter case, the absolute pressure of the feedstock constitutes the partial pressure of the hydrocarbon feedstock in the inert gas.

The various aspects of the present invention will now be described in greater detail however by example only with reference to the accompanying drawings, in which:—

FIG. 1 shows a process scheme in accordance with one embodiment of the present invention for processing refinery and/or petrochemical feedstocks, the process scheme incorporating a reactor for selectively catalytically cracking olefins into lighter olefins over a crystalline silicate catalyst and a downstream steam cracker; and FIGS. 2 to 5 show the relationship between the propylene/ethylene weight ratio and feedstock and temperature for various Examples of the present invention and Comparative Examples.

In accordance with one aspect of the present invention, catalytic cracking of olefins is performed in the sense that olefins in a hydrocarbon stream are cracked into lighter olefins and selectively into propylene. The feedstock and effluent preferably have substantially the same olefin content by weight. Typically, the olefin content of the effluent is within ±15 wt %, more preferably ±10 wt %, of the olefin content of the feedstock. The feedstock may comprise any kind of olefin-containing hydrocarbon stream. The feedstock may typically comprise from 10 to 100 wt % olefins and furthermore may be fed undiluted or diluted by a diluent, the diluent optionally including a non-olefinic hydrocarbon. In particular, the olefin-containing feedstock may be a hydrocarbon mixture containing normal and branched olefins in the carbon range $C_4$ to $C_{10}$, more preferably in the carbon range $C_4$ to $C_6$, optionally in a mixture with normal and branched paraffins and/or aromatics in the carbon range $C_4$ to $C_{10}$. Typically, the olefin-containing stream has a boiling point of from around −15 to around 180° C.

In particularly preferred embodiments of the present invention, the hydrocarbon feedstocks comprise $C_4$ mixtures from refineries and steam cracking units. Such steam cracking units crack a wide variety of feedstocks, including ethane, propane, butane, naphtha, gas oil, fuel oil, etc. Most particularly, the hydrocarbon feedstock may comprises a $C_4$ cut from a fluidized-bed catalytic cracking (FCC) unit in a crude oil refinery which is employed for converting heavy oil into gasoline and lighter products. Typically, such a $C_4$ cut from an FCC unit comprises around 50 wt % olefin. Alternatively, the hydrocarbon feedstock may comprise a $C_4$ cut from a unit within a crude oil refinery for producing methyl tert-butyl ether (MTBE) which is prepared from methanol and isobutene. Again, such a $C_4$ cut from the MTBE unit typically comprises around 50 wt % olefin. These $C_4$ cuts are fractionated at the outlet of the respective FCC or MTBE unit. The hydrocarbon feedstock may yet further comprise a $C_4$ cut from a naphtha steam-cracking unit of a petrochemical plant in which naphtha, comprising $C_5$ to $C_9$ species having a boiling point range of from about 15 to 180° C., is steam cracked to produce, inter alia, a $C_4$ cut. Such a $C_4$ cut typically comprises, by weight, 40 to 50% 1,3-butadiene, around 25% isobutylene, around 15% butene (in the form of but-1-ene and/or but-2-ene) and around 10% n-butane and/or isobutane. The olefin-containing hydrocarbon feedstock may also comprise a $C_4$ cut from a steam cracking unit after butadiene extraction (raffinate 1), or after butadiene hydrogenation, thereby comprising a hydrotreated $C_4$ stream (known in the art as a "hydrotreated raw $C_4$" stream), or a raw $C_4$ feedstock, or a raffinate 2 feedstock from an MTBE or an ethyl tert-butyl ether (ETBE) unit, or a raffinate from an olefins metathesis unit.

The feedstock may yet further alternatively comprise a hydrogenated butadiene-rich $C_4$ cut, typically containing greater than 50 wt % $C_4$ as an olefin. Alternatively, the hydrocarbon feedstock could comprise a pure olefin feedstock which has been produced in a petrochemical plant.

The olefin-containing feedstock may yet further alternatively comprise light cracked naphtha (LCN) (otherwise known as light catalytic cracked spirit (LCCS)) or a $C_5$ cut from a steam cracker or light cracked naphtha, the light cracked naphtha being fractionated from the effluent of the FCC unit, discussed hereinabove, in a crude oil refinery. Both such feedstocks contain olefins. The olefin-containing feedstock may yet further alternatively comprise a medium cracked naphtha from such an FCC unit or visbroken naphtha obtained from a visbrealing unit for treating the residue of a vacuum distillation unit in a crude oil refinery or a coker naphtha. The olefin-containing feedstock may alternatively comprise a raffinate 2 feedstock, containing olefins but having a high isoparaffin content.

The olefin-containing feedstock may comprise a mixture of one or more of the above-described feedstocks.

The use of a $C_5$ cut as or in the olefin-containing hydrocarbon feedstock has particular advantages because of the need to remove $C_5$ species in any event from gasolines produced by the oil refinery. This is because the presence of $C_5$ in gasoline increases the ozone potential and thus the photochemical activity of the resulting gasoline. In the case of the use of light cracked naphtha as the olefin-containing feedstock, the olefin content of the remaining gasoline fraction is reduced, thereby reducing the vapour pressure and also the photochemical activity of the gasoline.

In accordance with a preferred aspect of the process of the invention, olefinic feedstocks can be cracked selectively in the presence of an MFI-type or MEL-type catalyst so as to redistribute the olefinic content of the feedstock in the resultant effluent. The catalyst and process conditions are selected whereby the process has a particular yield on an olefin basis towards a specified olefin in the feedstocks. Typically, the catalyst and process conditions are chosen whereby the process has the same high yield on an olefin basis towards propylene irrespective of the origin of the olefinic feedstocks for example the $C_4$ cut from the FCC unit, the $C_4$ cut from the MTBE unit, the light cracked naphtha or the $C_5$ cut from the light crack naphtha, etc. The propylene yield on an olefin basis is typically from 30 to 50% based on the olefin content of the feedstock. The yield on an olefin basis of a particular olefin is defined as the weight of that olefin in the effluent divided by the initial total olefin content by weight. For example, for a feedstock with 50 wt % olefin, if the effluent contains 20 wt % propylene, the propylene yield on an olefin basis is 40%. This may be contrasted with the actual yield for a product which is defined as the weight amount of the product produced divided by the weight amount of the feed. The paraffins and the aromatics contained in the feedstock are only slightly converted in accordance with the preferred aspects of the invention.

In accordance with a preferred aspect of the present invention, the catalyst for the cracking of the olefins comprises a crystalline silicate of the MFI family which may be a zeolite, a silicalite or any other silicate in that family or the MEL family which may be a zeolite or any other silicate in that family. The three-letter designations "MFI" and "MEL" each represent a particular crystalline silicate structure type as established by the Structure Commission of the International Zeolite Association. Examples of MFI silicates are ZSM-5 and silicalite. An example of an MEL zeolite is ZSM-11 which is known in the art. Other examples are Boralite D, and silicalite-2 as described by the International Zeolite Association (Atlas of zeolite structure types, 1987, Butterworths).

The preferred crystalline silicates have pores or channels defined by ten oxygen rings and a high silicon/aluminium atomic ratio.

Crystalline silicates are microporous crystalline inorganic polymers based on a framework of $XO_4$ tetrahedra linked to each other by sharing of oxygen ions, where X may be trivalent (e.g. Al, B, . . . ) or tetravalent (e.g. Ge, Si, . . . ). The crystal structure of a crystalline silicate is defined by the specific order in which a network of tetrahedral units are linked together. The size of the crystalline silicate pore openings is determined by the number of tetrahedral units, or, alternatively, oxygen atoms, required to form the pores and the nature of the cations that are present in the pores. They possess a unique combination of the following properties: high internal surface area; uniform pores with one or more discrete sizes; ion exchangeability; good thermal stability; and ability to adsorb organic compounds. Since the pores of these crystalline silicates are similar in size to many organic molecules of practical interest, they control the ingress and egress of reactants and products, resulting in particular selectivity in catalytic reactions. Crystalline silicates with the MFI structure possess a bidirectional intersecting pore system with the following pore diameters: a straight channel along [010]: 0.53-0.56 nm and a sinusoidal channel along [100]: 0.51-0.55 nm. Crystalline silicates with the MEL structure possess a bi-directional intersecting straight pore system with straight channels along [100] having pore diameters of 0.53-0.54 nm.

The crystalline silicate catalyst has structural and chemical properties and is employed under particular reaction conditions whereby the catalytic cracking readily proceeds. Different reaction pathways can occur on the catalyst. Under the process conditions, having an inlet temperature of around 500 to 600° C., preferably from 520 to 600° C., yet more preferably 540 to 580° C., and an olefin partial pressure of from 0.1 to 2 bars, most preferably around atmospheric pressure, the shift of the double bond of an olefin in the feedstock is readily achieved, leading to double bond isomerisation. Furthermore, such isomerisation tends to reach a thermodynamic equilibrium. Propylene can be, for example, directly produced by the catalytic cracking of hexene or a heavier olefinic feedstock. Olefinic catalytic cracking may be understood to comprise a process yielding shorter molecules via bond breakage.

The catalyst preferably has a high silicon/aluminium atomic ratio, whereby the catalyst has relatively low acidity. In this specification, the term "silicon/aluminium atomic ratio" is intended to mean the Si/Al atomic ratio of the overall material, which may be determined by chemical analysis. In particular, for crystalline silicate materials, the stated Si/Al ratios apply not just to the Si/Al framework of the crystalline silicate but rather to the whole material.

Hydrogen transfer reactions are directly related to the strength and density of the acid sites on the catalyst, and such reactions are preferably suppressed so as to avoid the formation of coke during the olefin conversion process, and composition of the olefinic feedstock. Such high ratios reduce the acidity of the catalyst, thereby increasing the stability of the catalyst. Moreover, the use of high Si/Al atomic ratios has been found to increase the propylene selectivity of the catalyst, i.e. to reduce the amount of propane produced. This increases the purity of the resultant propylene.

In accordance with one aspect, a first type of MFI catalyst has a high silicon/aluminum atomic ratio, e.g. at least about 180, preferably greater than about 200, more preferably greater than about 300, whereby the catalyst has relatively low acidity. Hydrogen transfer reactions are directly related to the strength and density of the acid sites on the catalyst, and such reactions are preferably suppressed so as to avoid the formation of coke during the olefin conversion process, which in turn would otherwise decrease the stability of the catalyst over time. Such hydrogen transfer reactions tend to produce saturates such as paraffins, intermediate unstable dienes and cyclo-olefins, and aromatics, none of which favours cracking into light olefins. Cyclo-olefins are precursors of aromatics and coke-like molecules, especially in the presence of solid acids, i.e. an acidic solid catalyst. The acidity of the catalyst can be determined by the amount of residual ammonia on the catalyst following contact of the catalyst with ammonia which adsorbs to the acid sites on the catalyst with subsequent ammonium desorption at elevated temperature measured by differential thermogravimetric analysis. Preferably, the silicon/aluminum ratio ranges from 180 to 1000, most preferably from 300 to 500.

With such high silicon/aluminum ratio in the crystalline silicate catalyst, a stable olefin conversion can be achieved with a high propylene yield on an olefin basis of from 30 to 50% whatever the origin and composition of the olefinic feedstock. Such high ratios reduce the acidity of the catalyst, thereby increasing the stability of the catalyst.

The MFI catalyst having a high silicon/aluminum atomic ratio for use in the catalytic cracking process of the present invention may be manufactured by removing aluminum from a commercially available crystalline silicate. A typical commercially available silicalite has a silicon/aluminum atomic ratio of around 120. The commercially available MFI crystalline silicate may be modified by a steaming process which reduces the tetrahedral aluminum in the crystalline silicate framework and converts the aluminum atoms into octahedral aluminum in the form of amorphous alumina. Although in the steaming step aluminum atoms are chemically removed from the crystalline silicate framework structure to form alumina particles, those particles cause partial obstruction of the pores or channels in the framework. This inhibits the olefinic cracking processes of the present invention. Accordingly, following the steaming step, the crystalline silicate is subjected to an extraction step wherein amorphous alumina is removed from the pores and the micropore volume is, at least partially, recovered. The physical removal, by a leaching step, of the amorphous alumina from the pores by the formation of a water-soluble aluminum complex yields the overall effect of dealumination of the MFI crystalline silicate. In this way by removing aluminum from the MFI crystalline silicate framework and then removing alumina formed therefrom from the pores, the process aims at achieving a substantially homogeneous dealumination throughout the whole pore surfaces of the catalyst. This reduces the acidity of the catalyst, and thereby reduces the occurrence of hydrogen transfer reactions in the cracking process. The reduction of acidity ideally occurs substantially homogeneously throughout the pores defined in the crystalline silicate framework. This is because in the olefin cracking process hydrocarbon species can enter deeply into the prose. Accordingly, the reduction of acidity and thus the reduction in hydrogen transfer reactions which would reduce the stability of the MFI catalyst are pursued throughout the whole pore structure in the framework. The framework silicon/aluminum ratio may be increased by this process to a value of at least about 180, preferably from about 180 to 1000, more preferably at least 200, yet more preferably at least 300, and most preferably around 480.

In accordance with another aspect, a second type of MFI catalyst has a high silicon/aluminium atomic ratio, greater than about 300, whereby the catalyst has relatively low acidity and the catalyst has not been steamed or dealuminated as described hereinabove.

In accordance with a further aspect, an MEL catalyst for use in the catalytic cracking process may be manufactured by steaming an as-synthesised or commercially available crystalline silicate. The MEL crystalline silicate catalyst for use in the invention most typically comprises a ZSM-11 catalyst which may be synthesised either using diaminooctane as the templating agent and sodium silicate as the silicon source or tetrabutyl phosphonium bromide as the templating agent and a silica sol as the silicon source. Thus the ZSM-11 catalyst may be prepared by mixing sodium silicate with 1,8 diaminooctane together with aluminium sulphate to form a hydrogel which is then allowed to crystallise to form the crystalline silicate. The organic template material is then removed by calcining. Alternatively, the ZSM-11 catalyst is produced by reacting tetrabutyl phosphonium bromide and sodium hydroxide together with the silica sol prepared from colloidal silica. Again, a crystallisation is performed to produce the crystalline silicate and then the product is calcined.

In order to reduce the sodium content of the MEL crystalline silicate, the crystalline silicate is subjected to an ion exchange with a salt. Thereafter the material is dried. Typically, the crystalline silicate is subjected to ion exchange with ammonium ions, for example by immersing the crystalline silicate in an aqueous solution of $NH_4Cl$ or $NH_4NO_3$. Such an ion exchange step is desirable if the amount of sodium ions present in the crystalline silicate is so high that a crystalline sodium silicate phase is formed following calcination of the crystalline silicate which would be difficult to remove.

The initial MEL crystalline silicate may be modified by a steaming process which, without being bound by theory, is believed to reduce the tetrahedral aluminium in the crystalline silicate framework and to convert the aluminium atoms into octahedral aluminium in the form of amorphous alumina. Although in the steaming step aluminium atoms are chemically removed from the MEL crystalline silicate framework structure to form alumina particles, those particles appear not to migrate and so do not cause partial obstruction of the pores or channels in the framework which would otherwise inhibit the olefinic cracking processes of the present invention. The steaming step has been found to improve significantly the propylene yield, propylene selectivity and catalyst stability in the olefinic catalytic cracking process.

The steam treatment on the MEL catalyst is conducted at elevated temperature, preferably in the range of from 425 to 870° C., more preferably in the range of from 540 to 815° C. and at atmospheric pressure and at a water partial pressure of from 13 to 200 kPa. Preferably, the steam treatment is conducted in an atmosphere comprising from 5 to 100% steam. The steam treatment is preferably carried out for a period of from 1 to 200 hours, more preferably from 20 hours to 100 hours. As stated above, the steam treatment tends to reduce the amount of tetrahedral aluminium in the crystalline silicate framework, by forming alumina.

Following the steaming step, the MEL catalyst is thereafter calcined, for example at a temperature of from 400 to 800° C. at atmospheric pressure for a period of from 1 to 10 hours.

Following the steaming step, the MEL catalyst may be contacted by a complexing agent for aluminium which may comprise an organic acid in an aqueous solution thereof or a salt of such an organic acid or a mixture of two or more such acids or salts. The complexing agent may in particular comprise an amine, such as ethyl diamine tetraacetic acid (EDTA) or a salt thereof, in particular the sodium salt thereof. Following the contacting of the MEL crystalline silicate by the complexing agent, the crystalline silicate may be subjected to a second ion exchange step for reducing the sodium content of the crystalline silicate still further, for example by contacting the catalyst with an ammonium nitrate solution.

The MEL or MFI crystalline silicate catalyst may be mixed with a binder, preferably an inorganic binder, and shaped to a desired shape, e.g. extruded pellets. The binder is selected so as to be resistant to the temperature and other conditions employed in the catalyst manufacturing process and in the subsequent catalytic cracking process for the olefins. The binder is an inorganic material selected from clays, silica, metal oxides such as $ZrO_2$ and/or metals, or gels including mixtures of silica and metal oxides. The binder is preferably alumina-free. If the binder which is used in conjunction with the crystalline silicate is itself catalytically active, this may alter the conversion and/or the selectivity of the catalyst. Inactive materials for the binder may suitably serve as diluents to control the amount of conversion so that products can be obtained economically and orderly without employing other means for controlling the reaction rate. It is desirable to provide a catalyst having a good crush strength. This is because in commercial use, it is desirable to prevent the catalyst from breaking down into powder-like materials. Such clay or oxide binders have been employed normally only for the purpose of improving the crush strength of the catalyst. A particularly preferred binder for the catalyst of the present invention comprises silica.

The relative proportions of the finely divided crystalline silicate material and the inorganic oxide matrix of the binder can vary widely. Typically, the binder content ranges from 5 to 95% by weight, more typically from 20 to 50% by weight, based on the weight of the composite catalyst. Such a mixture of crystalline silicate and an inorganic oxide binder is referred to as a formulated crystalline silicate.

In mixing the catalyst with a binder, the catalyst may be formulated into pellets, extruded into other shapes, or formed into a spray-dried powder.

Typically, the binder and the crystalline silicate catalyst are mixed together by an extrusion process. In such a process, the binder, for example silica, in the form of a gel is mixed with the crystalline silicate catalyst material and the resultant mixture is extruded into the desired shape, for example pellets. Thereafter, the formulated crystalline silicate is calcined in air or an inert gas, typically at a temperature of from 200 to 900° C. for a period of from 1 to 48 hours.

The binder preferably does not contain any aluminium compounds, such as alumina. This is because as mentioned above the preferred catalyst has a selected silicon/aluminium ratio of the crystalline silicate. The presence of alumina in the binder yields other excess alumina if the binding step is performed prior to the aluminium extraction step. If the aluminium-containing binder is mixed with the crystalline silicate catalyst following aluminum extraction, this re-aluminates the catalyst. The presence of aluminium in the binder would tend to reduce the olefin selectivity of the catalyst, and to reduce the stability of the catalyst over time.

In addition, the mixing of the catalyst with the binder may be carried out either before or after any steaming step.

The various preferred catalysts have been found to exhibit high stability, in particular being capable of giving a stable propylene yield over several days, e.g. up to ten days. This enables the olefin cracking process to be performed continuously in two parallel "swing" reactors wherein when one reactor is operating, the other reactor is undergoing catalyst regeneration. The catalyst also can be regenerated several times. The catalyst is also flexible in that it can be employed to crack a variety of feedstocks, either pure or mixtures, coming from different sources in the oil refinery or petrochemical plant and having different compositions.

In the process for catalytic cracking of olefins when dienes are present in the olefin-containing feedstock, this can provoke a faster deactivation of the catalyst. This can greatly decrease the yield on an olefin basis of the catalyst to produce the desired olefin, for example propylene, with increasing time on stream. When dienes are present in the feedstock which is catalytically cracked, this can yield a gum derived from the diene being formed on the catalyst which in turn decreases the catalyst activity. It is desired for the catalyst to have a stable activity over time, typically for at least ten days.

In accordance with this aspect, prior to the catalytic cracking of the olefins, if the olefin-containing feedstock contains dienes, the feedstock is subjected to a selective hydrogenation process in order to remove the dienes. The hydrogenation process requires to be controlled in order to avoid the saturation of the mono-olefins. The hydrogenation process preferably comprises nickel-based or palladium-based catalysts or other catalysts which are typically used for first stage pyrolysis gasoline (Pygas) hydrogenation. When such nickel-based catalysts are used with a $C_4$ cut, a significant conversion of the mono-olefins into paraffins by hydrogenation cannot be avoided. Accordingly, such palladium-based catalysts, which are more selective to diene hydrogenation, are more suitable for use with the $C_4$ cut.

A particularly preferred catalyst is a palladium-based catalyst, supported on, for example, alumina and containing 0.2-0.8 wt % palladium based on the weight of the catalyst. The hydrogenation process is preferably carried out at an absolute pressure of from 5 to 50 bar, more preferably from 10 to 30 barand at an inlet temperature of from 40 to 200° C. Typically, the hydrogen/diene weight ratio is at least 1, more preferably from 1 to 5, most preferably around 3. Preferably, the liquid hourly space velocity (LHSV) is at least 2 $h^{-1}$, more preferably from 2 to 5 $h^{-1}$.

The dienes in the feedstock are preferably removed so as to provide a maximum diene content in the feedstock of around 0.1% by weight, preferably around 0.05% by weight, more preferably around 0.03% by weight.

In the catalytic cracking process, the process conditions are selected in order to provide high selectivity towards propylene, a stable olefin conversion over time, and a stable olefinic product distribution in the effluent. Such objectives are favoured by the use of a low acid density in the catalyst (i.e. a high Si/Al atomic ratio) in conjunction with a low pressure, a high inlet temperature and a short contact time, all of which process parameters are interrelated and provide an overall cumulative effect (e.g. a higher pressure may be offset or compensated by a yet higher inlet temperature). The process conditions are selected to disfavour hydrogen transfer reactions leading to the formation of paraffins, aromatics and coke precursors. The process operating conditions thus employ a high space velocity, a low pressure and a high reaction temperature. The LHSV ranges from 5 to 30 $h^{-1}$, preferably from 10 to 30 $h^{-1}$. The olefin partial pressure ranges from 0.1 to 2 bars, preferably from 0.5 to 1.5 bars. A particularly preferred olefin partial pressure is atmospheric pressure (i.e. 1 bar). The hydrocarbon feedstocks are preferably fed at a total inlet pressure sufficient to convey the feedstocks through the reactor. The hydrocarbon feedstocks may be fed undiluted or diluted in an inert gas, e.g. nitrogen. Preferably, the total absolute pressure in the reactor ranges from 0.5 to 10 bars. The use of a low olefin partial pressure, for example atmospheric pressure, tends to lower the incidence of hydrogen transfer reactions in the cracking process, which in turn reduces the potential for coke formation which tends to reduce catalyst stability. The cracking of the olefins is preferably performed at an inlet temperature of the feedstock of from 500 to 600° C., more preferably from 520 to 600° C., yet more preferably from 540 to 580° C., typically around 560° C. to 570° C.

The catalytic cracking process can be performed in a fixed bed reactor, a moving bed reactor or a fluidized bed reactor. A typical fluid bed reactor is one of the FCC type used for fluidized-bed catalytic cracking in the oil refinery. A typical moving bed reactor is of the continuous catalytic reforming type. As described above, the process may be performed continuously using a pair of parallel "swing" fixed bed reactors.

Since the catalyst exhibits high stability to olefinic conversion for an extended period, typically at least around ten days, the frequency of regeneration of the catalyst is low. More particularly, the catalyst may accordingly have a lifetime which exceeds one year.

For example, olefin-rich streams from refinery or petrochemical plants are cracked into light olefins, in particular propylene. The light fractions of the effluent, namely the $C_2$ and $C_3$ cuts, can contain more than 92% olefins. Such cuts are sufficiently pure to constitute chemical grade olefin feedstocks. The propylene yield on an olefin basis in such a process can range from 30 to 50% based on the olefinic content of the feedstock which contains one or more olefins of $C_4$ or greater. In the process, the effluent has a different olefin distribution as compared to that of the feedstock, but substantially the same total olefin content.

Referring to FIG. 1, there is shown a process scheme incorporating a reactor for cracking an olefin-rich hydrocarbon feedstock which is selective towards light olefins in the effluent. The process scheme may integrate such a reactor into an oil refinery.

As shown in FIG. 1, the process scheme includes a reactor 2 for selectively catalytically cracking an olefin-rich hydrocarbon feedstock to form light olefins, such as propylene. The reactor 2 is typically a fixed bed reactor, and contains as a catalyst a crystalline silicate of the MFI or MEL type as described hereinabove. The reactor 2 is also operated under the temperature, flow rate and pressure conditions as described herein for the selective catalytic cracking process. The reactor 2 is fed along an input 4 with one or more of a variety of olefin-rich hydrocarbon feedstocks derived from a petrochemical plant and/or derived from an oil refinery.

The petrochemical feedstocks which are fed along input 4 may particularly comprise at least one of a hydrotreated raw $C_4$ feedstock, LCCS, a raffinate 2 feedstock, a raffinate 1 feedstock, a raffinate 2 feedstock from a methyl tert-butyl ether (MTBE) or an ethyl tert-butyl ether (ETBE) unit, a raffinate from an olefins metathesis unit, in particular for the production of propylene from ethylene and butene, or a hydrotreated olefin-containing stream from an FCC unit, a visbreaker or a delayed coker.

The selective catalytic cracking process in the reactor 2, as well as cracking the feedstock olefins into lighter olefins, in particular propylene, can also desulphurise the incoming hydrocarbon feedstock by decomposition (or cracking) of any mercaptans (which may be present as impurities in an FCC feedstock) into valuable olefins and hydrogen sulphide. The hydrogen sulphide is subsequently removed in the reactor 2 or from the effluent by techniques known in the art. The use of an MFI-type crystalline silicate such as silicalite which is not highly sensitive to poisoning by heteroatoms such as sulphur in combination with this desulphurisation process enables the provision of a smaller sweetening unit (not shown), or the provision of a sweetening unit operating under reduced load, than would otherwise be required for treating an FCC feedstock containing sulphur as an impurity. Thus the use of the reactor for selective catalytic cracking of the olefin-containing hydrocarbon feedstock additionally desulphurises the incoming $C_4$+ FCC effluent thereby reducing the capital and operating costs of the known sweetening unit for FCC effluents.

The effluent from the reactor 2 is outputted along a line 6 to a first (de-$C_3$) fractionator 8 in which the effluent is fractionated into a $C_2/C_3$ overhead fraction outputted along line 10 and a $C_4$+ bottom fraction outputted along line 12. The $C_2/C_3$ fraction, including a high proportion of propylene, is fed to a second fractionator 14 via a common input line 16 therefor.

The $C_4$+ fraction outputted on line 12 from the first fractionator is fed via an input 18 to a steam cracker 20.

The steam cracker 20 is of a construction generally known in the art which comprises a plurality of heating coils, in a plurality of furnaces of the steam cracker, over which the feedstock is passed, together with steam. The feedstock is heated, prior to introduction into the steam cracker 20, to a temperature, known as the inlet radiation temperature, which typically ranges from 535 to 620° C., most typically being about 600° C. In the steam cracker 20, the temperature of the coils, known as the coil outlet temperature, is typically from 760 to 860° C., most typically about 780° C. The coil inlet pressure for the steam cracker typically ranges from 2 to 4 bara, most typically from 2.6 to 2.9 bara, and the coil outlet pressure is most typically from 2 to 3 bara, most typically about 2.15 bara. The steam is introduced into the steam cracker in a weight ratio with respect to the total hydrocarbon feed to the steam cracker of from 0.1 steam: 1 hydrocarbon feedstock, most typically about 0.35 steam: 1 hydrocarbon feedstock on a weight basis. The throughput of the steam cracker 20 used in the invention is typically about 14 tonnes of hydrocarbon feedstock per hour.

In accordance with the illustrated embodiment of the invention, but not essential to the method of the invention, the hydrocarbon feedstock supplied to the steam cracker 20 also includes a second hydrocarbon feedstock fraction, which may typically comprise a straight run naphtha, which is fed along a line 22 via a plurality of parallel inputs 24,26,28 into the steam cracker 20. Accordingly, the composite feedstock for the steam cracker 20 comprises the $C_4$+ fraction fed on input 18 together with the feedstock fed on inputs 24,26 and 28.

In accordance with a preferred aspect, the respective hydrocarbon feedstocks on inputs 18, 24, 26 and 28 are steam cracked in respective furnaces of a common steam cracker 20. Thus, preferably, each feedstock is steam cracked in dedicated furnace(s) of the steam cracker 20.

In particular, it is desired that the olefins are cracked at low severity (temperature) whereas naphthas are preferably cracked at higher severity (temperature).

When the hydrocarbon feedstock fed on line 22 comprises a straight run naphtha, the straight run naphtha typically comprises $C_5$-$C_9$ straight and/or isoparaffins with substantially no olefinic content, but however paraffins of $C_{9+}$ may additionally be present.

The effluent from the steam cracker 20 is outputted along an output 30 which is fed into the common input 16 for the second fractionator 14. The second fractionator 14 commonly fractionates both combined effluents on lines 10 and 30 respectively, and the output of the second fractionator 14 comprises individual fractions of $C_2$, $C_3$, etc. which are recovered.

The recovered $C_3$ fraction has a high proportion, typically greater than 94 wt %, propylene. This comprises chemical-grade propylene which may be used in subsequent processes as a starting feedstock, for example in the production of polypropylene.

In accordance with the present invention therefore, olefinic feedstocks are subject to a catalytic cracking process which selectively catalytically cracks the olefins in the feedstock and thereafter, the effluent is separated into a $C_2$- and $C_3$-combined product that is recovered in a common fractionation train, and into $C_4$+ products which are routed to a dedicated steam cracking furnace, with the effluent from the steam cracking furnace thereafter being sent to the common fractionation train. The steam cracker may optionally be fed with additional hydrocarbon feedstocks which substantially do not comprise olefins, such as for example a straight run naphtha.

It has been found in accordance with the present invention that the use of an olefin cracking step as a feed pre-treatment for the steam cracking of olefinic feedstocks allows the propylene/ethylene ratio in the steam cracking effluent to be shifted to values higher than the normal ranges observed when a straight run naphtha is subject to steam cracking. In an existing steam cracking plant the throughput of the steam cracking furnace has a maximum value, and thus the present invention provides the advantage that, without increasing the maximum throughput permitted by the steam cracker, the increase of the propylene yield using the steam cracker may be dramatically increased by changing the feedstocks for the steam cracker and in particular by using olefinic cracking as a pre-treatment for at least part of the steam cracking, with additional pre-fractionation of the effluent from the olefinic cracking process so as to remove propylene and ethylene primarily from the feedstock for the steam cracker. Some existing petrochemical plants currently generate a raw $C_4$ hydrocarbon stream containing olefins which often need to be recycled. The process of the present invention enables such raw $C_4$ hydrocarbon streams containing olefins to be incorporated into the steam cracking scheme so as to provide valuable effluents.

With regard to the operation of the steam cracker, it has been found that the optimum for propylene production in the steam cracker, measured by the propylene/ethylene weight ratio, tends to occur when the steam cracker is operated at low severity, typically at a temperature of from 760 to 860° C., most typically about 780° C. It has also been found that when the steam cracker is operated at such low severity, the steam cracker is subjected to reduced coking of the coils, i.e. reduced progressive build up of carbon deposits on the coils, which is in turn favourable for longer runs of the ovens between shutdown and overhaul.

The present invention will now be described in greater detail with reference to the flowing non-limiting Examples.

COMPARATIVE EXAMPLES 1 to 4

These Comparative Examples were computer simulated using the SPYRO simulation software known in the art, in which a straight run naphtha having a simulated composition was subjected to simulated steam cracking in a steam cracker.

In Comparative Example 1, the simulated composition shown in Table 1 (NPAR, IPAR, NAP and ARO respectively represent N-paraffins, isoparaffins, naphthenes and aromatics) was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.67 bara and a coil outlet pressure of 2.15 bara. The residence time was 515 milliseconds. The duty of the cracker was 9.6 megawatts. For an inlet flow rate of 14200 kg per hour, the effluent included 2872 kg per hour ethylene and 2520 kg per hour propylene, yielding a propylene/ethylene weight ratio of 0.878.

In Comparative Examples 2 to 4, the same naphtha feedstock was similarly subjected to simulated steam cracking at coil outlet temperatures of 800, 820 and 840° C. respectively using a constant steam cracker feed rate (14.2 tonnes per hour).

In Comparative Example 2, the simulated conditions were modified to have a coil inlet pressure of 2.69 bara. The residence time was 500 milliseconds. The duty of the cracker was 10.5 megawatts. For an inlet flow rate of 14200 kg per hour, the effluent included 3312 kg per hour ethylene and 2571 kg per hour propylene, yielding a propylene/ethylene weight ratio of 0.776.

In Comparative Example 3, the simulated conditions were modified to have a coil inlet pressure of 2.71 bara. The residence time was 487 milliseconds. The duty of the cracker was 11.3 megawatts. For an inlet flow rate of 14200 kg per hour, the effluent included 3693 kg per hour ethylene and 2486 kg per hour propylene, yielding a propylene/ethylene weight ratio of 0.673.

In Comparative Example 4, the simulated conditions were modified to have a coil inlet pressure of 2.72 bara. The residence time was 477 milliseconds. The duty of the cracker was 12.0 megawatts. For an inlet flow rate of 14200 kg per hour, the effluent included 4007 kg per hour ethylene and 2281 kg per hour propylene, yielding a propylene/ethylene weight ratio of 0.569.

Figure 2:
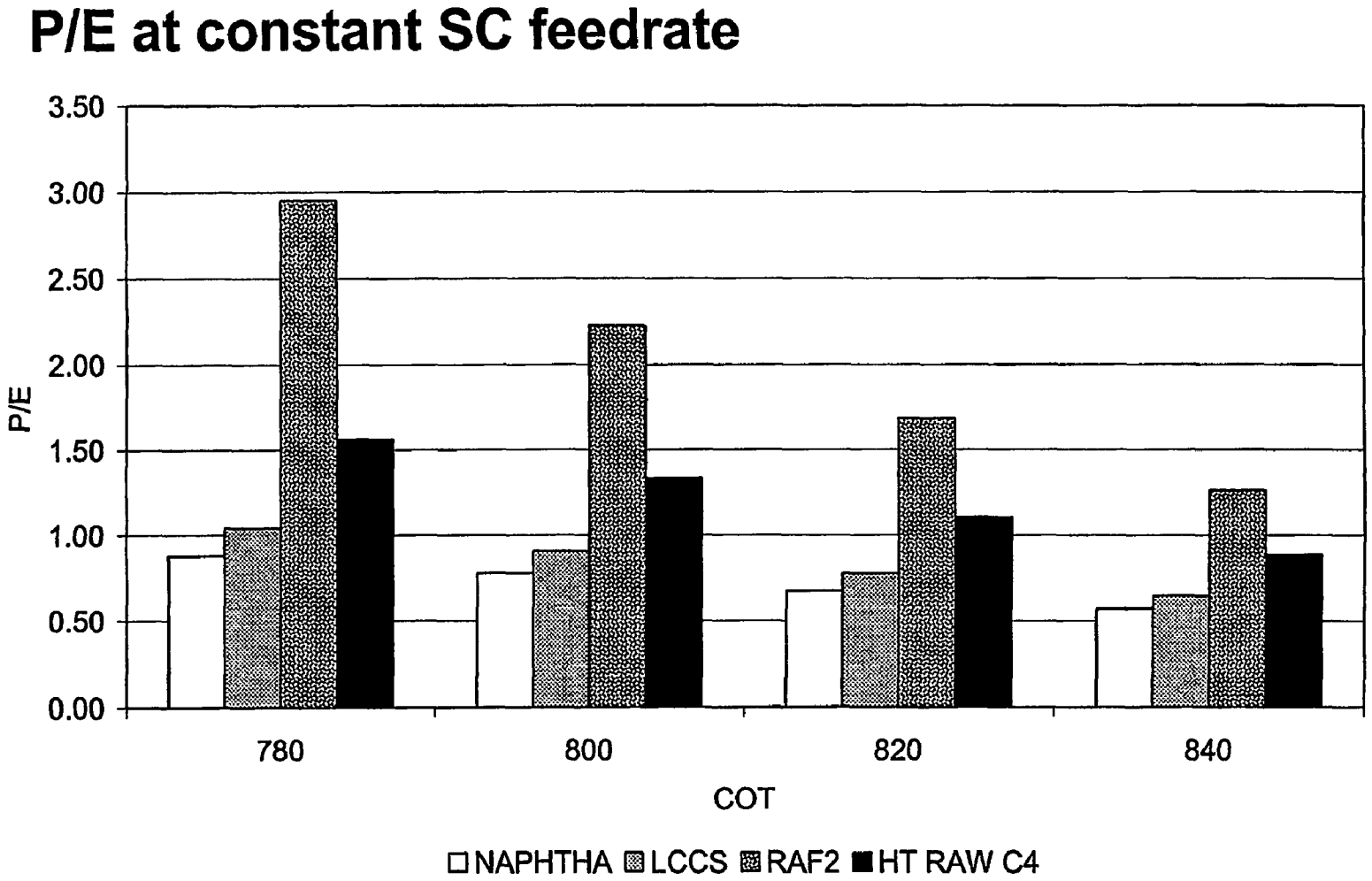

It may be seen from these Comparative Examples that the propylene/ethylene weight ratio for the steam cracking of the straight run naphtha is a maximum of 0.878 at 780° C., and this decreases with increasing coil outlet temperatures. These results are shown in FIG. 2.

COMPARATIVE EXAMPLES 5 to 8

In these Comparative Examples, an LCCS having the simulated composition shown in Table 2 was subjected to simulated steam cracking at coil outlet temperatures of 780, 800, 820 and 840° C. under the conditions summarised below and the propylene/ethylene weight ratio of the effluent at constant steam cracker feed rate are also summarised in FIG. 2.

In Comparative Example 5, the simulated composition shown in Table 2 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.64 bara and a coil outlet pressure of 2.15 bara. The residence time was 540 milliseconds. The duty of the cracker was 7.7 megawatts. For an inlet flow rate of 14200 kg per hour, the effluent included 1874 kg per hour ethylene and 1952 kg per hour propylene, yielding a propylene/ethylene weight ratio of 1.041.

In Comparative Examples 6 to 8, the same LCCS feedstock was similarly subjected to simulated steam cracking at coil outlet temperatures of 800, 820 and 840° C. respectively using a constant steam cracker feed rate (14.2 tonnes per hour).

In Comparative Example 6, the simulated conditions were modified to have a coil inlet pressure of 2.66 bara. The residence time was 527 milliseconds. The duty of the cracker was 8.3 megawatts. For an inlet flow rate of 14200 kg per hour, the effluent included 2135 kg per hour ethylene and 1940 kg per hour propylene, yielding a propylene/ethylene weight ratio of 0.908.

In Comparative Example 7, the simulated conditions were modified to have a coil inlet pressure of 2.67 bara. The residence time was 516 milliseconds. The duty of the cracker was 8.8 megawatts. For an inlet flow rate of 14200 kg per hour, the effluent included 2376 kg per hour ethylene and 1841 kg per hour propylene, yielding a propylene/ethylene weight ratio of 0.775.

In Comparative Example 8, the simulated conditions were modified to have a coil inlet pressure of 2.68 bara. The residence time was 505 milliseconds. The duty of the cracker was 9.3 megawatts. For an inlet flow rate of 14200 kg per hour, the effluent included 2592 kg per hour ethylene and 1666 kg per hour propylene, yielding a propylene/ethylene weight ratio of 0.643.

COMPARATIVE EXAMPLES 9 to 12

In these Comparative Examples, a raffinate 2 having the simulated composition shown in Table 3 was subjected to simulated steam cracking at coil outlet temperatures of 780, 800, 820 and 840° C. under the conditions summarised below and the propylene/ethylene weight ratio of the effluent at constant steam cracker feed rate are also summarised in FIG. 2.

In Comparative Example 9, the simulated composition shown in Table 3 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.67 bara and a coil outlet pressure of 2.15 bara. The residence time was 497 milliseconds. The duty of the cracker was 6.2 megawatts. For an inlet flow rate of 14200 kg per hour, the effluent included 859 kg per hour ethylene and 2535 kg per hour propylene, yielding a propylene/ethylene weight ratio of 2.95.

In Comparative Examples 10 to 12, the same raffinate 2 feedstock was similarly subjected to simulated steam cracking at coil outlet temperatures of 800, 820 and 840° C. respectively using a constant steam cracker feed rate (14.2 tonnes per hour).

In Comparative Example 10, the simulated conditions were modified to have a coil inlet pressure of 2.68 bara. The residence time was 481 milliseconds. The duty of the cracker was 7.1 megawatts. For an inlet flow rate of 14200 kg per hour, the effluent included 1260 kg per hour ethylene and 2808 kg per hour propylene, yielding a propylene/ethylene weight ratio of 2.228.

In Comparative Example 11, the simulated conditions were modified to have a coil inlet pressure of 2.69 bara. The residence time was 467 milliseconds. The duty of the cracker was 7.8 megawatts. For an inlet flow rate of 14200 kg per hour, the effluent included 1679 kg per hour ethylene and 2824 kg per hour propylene, yielding a propylene/ethylene weight ratio of 1.682.

In Comparative Example 12, the simulated conditions were modified to have a coil inlet pressure of 2.70 bara. The residence time was 455 milliseconds. The duty of the cracker was 8.5 megawatts. For an inlet flow rate of 14200 kg per hour, the effluent included 2087 kg per hour ethylene and 2631 kg per hour propylene, yielding a propylene/ethylene weight ratio of 1.261.

COMPARATIVE EXAMPLES 13 to 16

In these Comparative Examples, a hydrotreated raw $C_4$ hydrocarbon feedstock having the simulated composition shown in Table 4 was subjected to simulated steam cracking at coil outlet temperatures of 780, 800, 820 and 840° C. under the conditions summarised below and the propylene/ethylene weight ratio of the effluent at constant steam cracker feed rate are also summarised in FIG. 2.

In Comparative Example 13, the simulated composition shown in Table 4 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.66 bara and a coil outlet pressure of 2.15 bara. The residence time was 502 milliseconds. The duty of the cracker was 5.0 megawatts. For an inlet flow rate of 14200 kg per hour, the effluent included 1373 kg per hour ethylene and 2141 kg per hour propylene, yielding a propylene/ethylene weight ratio of 1.560.

In Comparative Examples 14 to 16, the same hydrotreated raw $C_4$ hydrocarbon feedstock was similarly subjected to simulated steam cracking at coil outlet temperatures of 800, 820 and 840° C. respectively using a constant steam cracker feed rate (14.2 tonnes per hour).

In Comparative Example 14, the simulated conditions were modified to have a coil inlet pressure of 2.67 bara. The residence time was 491 milliseconds. The duty of the cracker was 5.4 megawatts. For an inlet flow rate of 14200 kg per hour, the effluent included 1676 kg per hour ethylene and 2233 kg per hour propylene, yielding a propylene/ethylene weight ratio of 1.333.

In Comparative Example 15, the simulated conditions were modified to have a coil inlet pressure of 2.68 bara. The residence time was 480 milliseconds. The duty of the cracker was 5.8 megawatts. For an inlet flow rate of 14200 kg per hour, the effluent included 1964 kg per hour ethylene and 2172 kg per hour propylene, yielding a propylene/ethylene weight ratio of 1.106.

In Comparative Example 16, the simulated conditions were modified to have a coil inlet pressure of 2.70 bara. The residence time was 471 milliseconds. The duty of the cracker was 6.2 megawatts. For an inlet flow rate of 14200 kg per hour, the effluent included 2236 kg per hour ethylene and 1982 kg per hour propylene, yielding a propylene/ethylene weight ratio of 0.886.

EXAMPLES 1 to 4

In these Examples, the simulated LCCS of Comparative Examples 5 to 8 was initially subjected to a simulated olefin catalytic cracking process so as to produce a simulated effluent therefrom having the composition shown in Table 5. This effluent was then subjected to simulated steam cracking at the four temperatures of 780, 800, 820 and 840° C. under the conditions summarised below to yield respective propylene/ethylene weight ratios of 1.521, 1.242, 1.009 and 0.805, which are summarised in FIG. 3.

In Example 1, the simulated composition shown in Table 5 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.65 bara and a coil outlet pressure of 2.15 bara. The residence time was 523 milliseconds. The duty of the cracker was 6.3 megawatts. For an inlet flow rate of 14200 kg per hour, the effluent included 1729 kg per hour ethylene and 2629 kg per hour propylene, yielding a propylene/ethylene weight ratio of 1.521.

In Examples 2 to 4, the same simulated catalytically cracked LCCS feedstock was similarly subjected to simulated steam cracking at coil outlet temperatures of 800, 820 and 840° C. respectively using a constant steam cracker feed rate (14.2 tonnes per hour).

In Example 2, the simulated conditions were modified to have a coil inlet pressure of 2.66 bara. The residence time was 510 milliseconds. The duty of the cracker was 6.9 megawatts. For an inlet flow rate of 14200 kg per hour, the effluent included 2029 kg per hour ethylene and 2521 kg per hour propylene, yielding a propylene/ethylene weight ratio of 1.242.

In Example 3, the simulated conditions were modified to have a coil inlet pressure of 2.68 bara. The residence time was 499 milliseconds. The duty of the cracker was 7.5 megawatts. For an inlet flow rate of 14200 kg per hour, the effluent included 2302 kg per hour ethylene and 2323 kg per hour propylene, yielding a propylene/ethylene weight ratio of 1.009.

In Example 4, the simulated conditions were modified to have a coil inlet pressure of 2.70 bara. The residence time was 489 milliseconds. The duty of the cracker was 7.9 megawatts. For an inlet flow rate of 14200 kg per hour, the effluent included 2545 kg per hour ethylene and 2048 kg per hour propylene, yielding a propylene/ethylene weight ratio of 0.805.

In Example 1 the build up of coke on the coils on the steam cracker was estimated as part of the simulation. In the Spyro simulation model the coil in the furnace is shaped as a W and has four coil positions where coke measurements can be made or estimated. The calculated values were 0.4 equivalent mm per month for coil position 1, 0.5 equivalent mm per month for coil position 2, 0.7 equivalent mm per month for coil position 3 and 0.8 equivalent mm per month for coil position 4. In contrast, for Example 2 the corresponding coking values were 0.5, 0.6, 0.9 and 1.2 equivalent mm per month, for Example 3 the corresponding coking values were 0.6, 0.7, 1.1 and 1.6 equivalent mm per month and for Example 4 the corresponding coking values were 0.7, 0.9, 1.4 and 2.1 equivalent mm per month.

These values show that there is reduced coking when the steam cracker is operated at a low severity, in particular at about 780° C.

EXAMPLES 5 to 8

In these Examples, which are modifications to Examples 1 to 4, the simulated LCCS was initially subjected to simulated olefinic catalytic cracking to produce the composition of Table 5 and then additionally subjected to simulated fractionation from the effluent of $C_3$ and $C_2$ in the effluent to produce the composition of Table 6 and then followed by simulated steam cracking under substantially the same conditions as for the corresponding Examples 1 to 4. The feed rate was 14.2 tonnes per hour for the steam cracker and an initial inlet feed rate for the olefinic catalytic cracker was 16938.9 kg/hour, since the $C_3/C_2$ overhead fraction from the fractionator bypassed the steam cracker.

For Example 5 the propylene/ethylene weight ratio was 1.802 for the composite effluent to be sent to the combined fractionator.

For Examples 6, 7 and 8, the corresponding propylene/ethylene weight ratios in the composite effluent were 1.608, 1.428 and 1.262.

Figure 3:
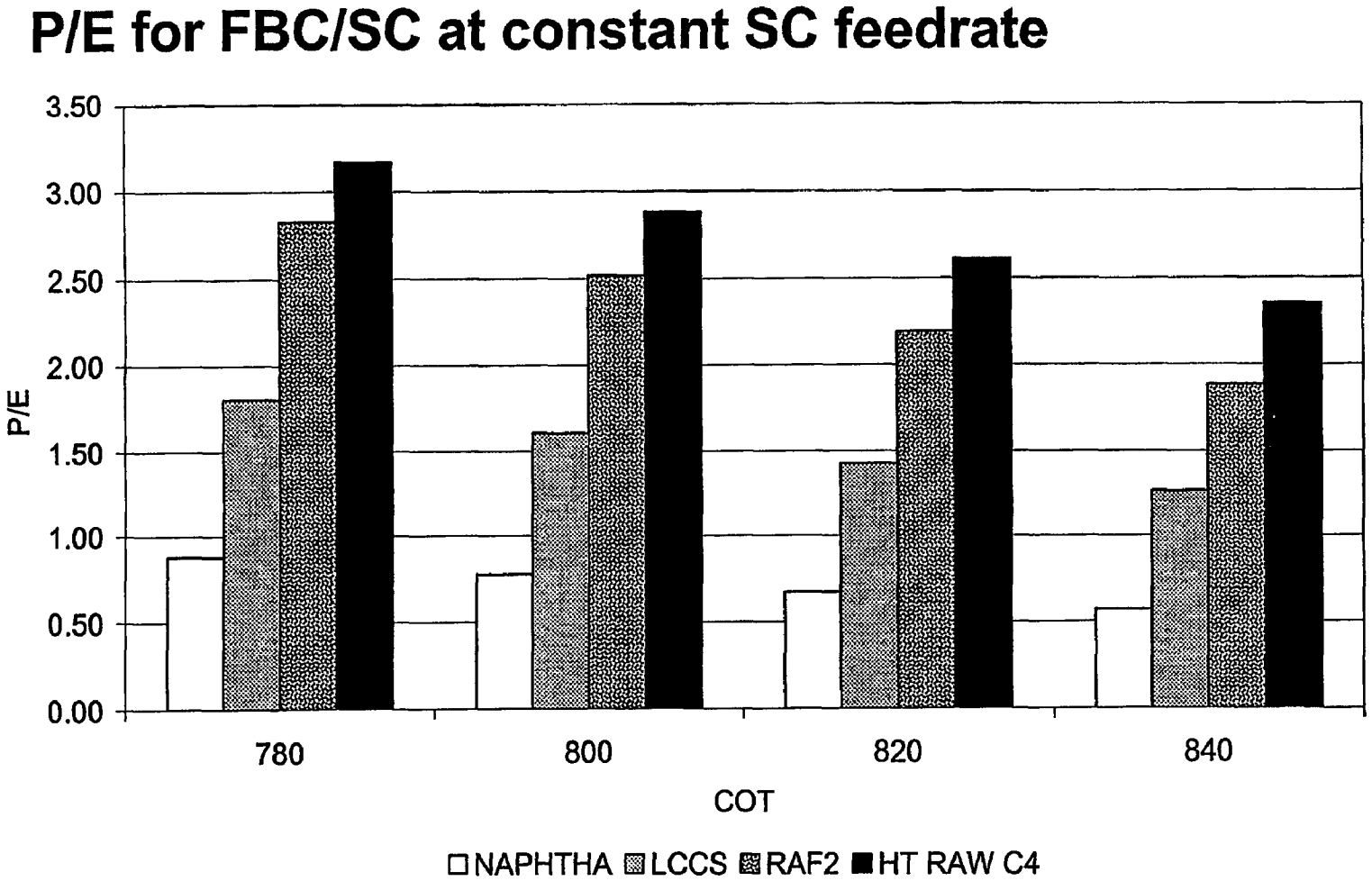
Figure 4:
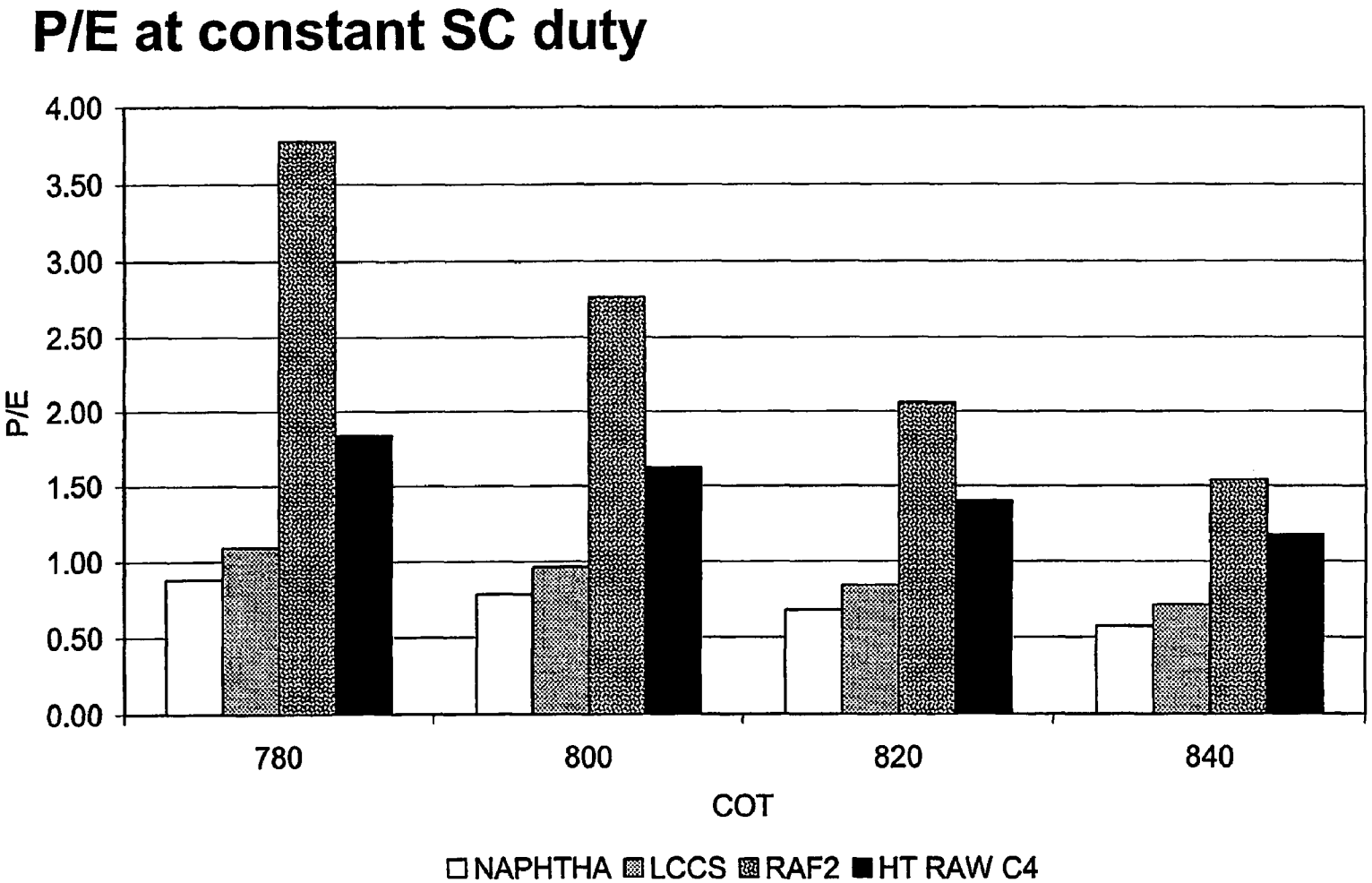
Figure 5:
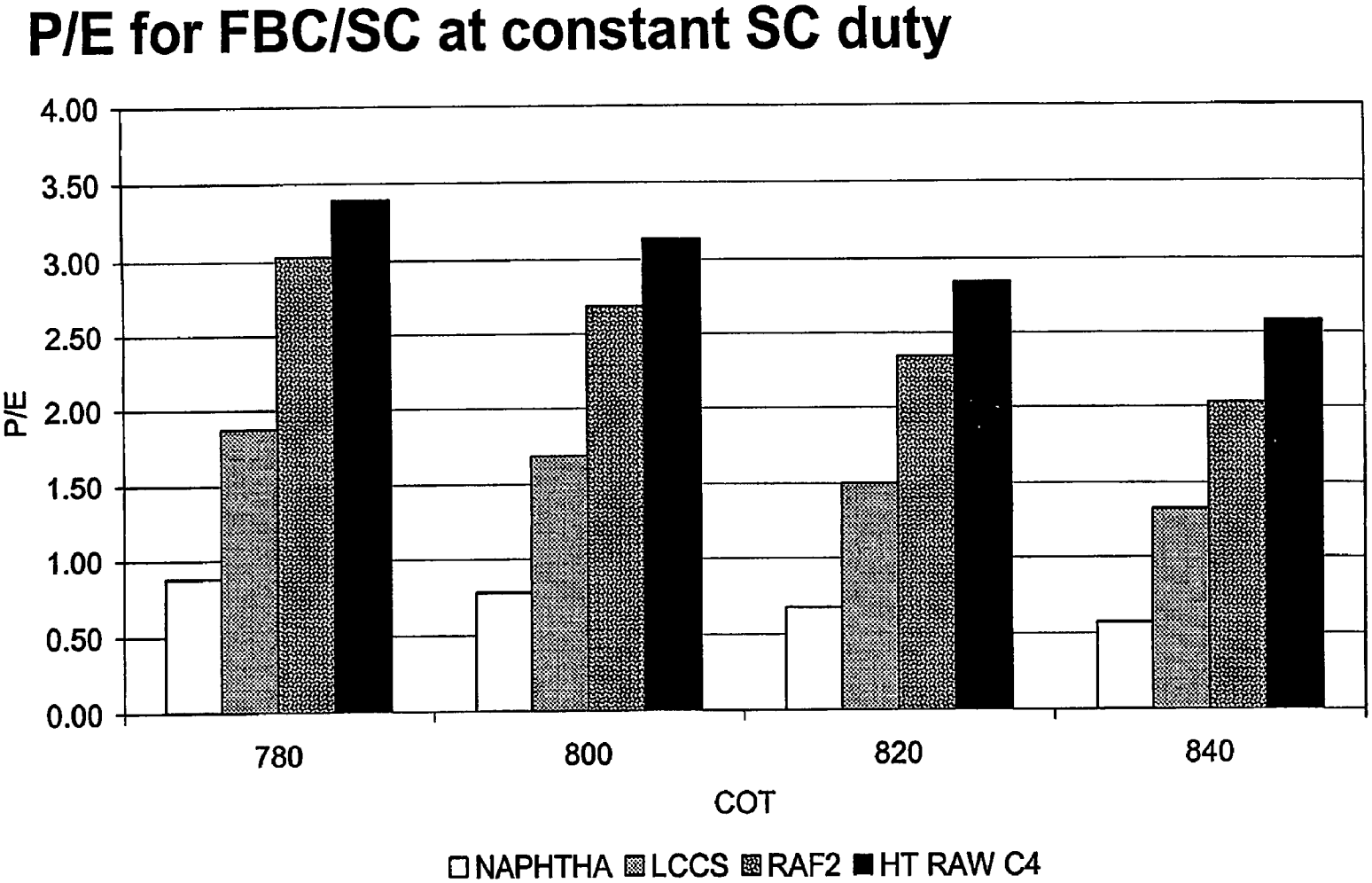

The total propylene/ethylene weight ratio results for each temperature are summarised in FIG. 3.

As for Examples 1 to 4 the build up of coke on the coils on the steam cracker was estimated and the corresponding values were for Example 5 0.0, 0.1, 0.2 and 0.4 equivalent mm per month, for Example 6 the corresponding coking values were 0.0, 0.2, 0.4 and 0.6 equivalent mm per month, for Example 7 the corresponding coking values were 0.1, 0.3, 0.6 and 1.0 equivalent mm per month and for Example 8 the corresponding coking values were 0.1, 0.4, 0.8 and 1.5 equivalent mm per month.

These values show that there is reduced coking when the steam cracker is operated at a low severity, in particular at about 780° C.

EXAMPLES 9 to 12

In these Examples, the simulated raffinate 2 of Comparative Examples 9 to 12 was initially subjected to a simulated olefin catalytic cracking process so as to produce a simulated effluent therefrom having the composition shown in Table 7. This effluent was then subjected to simulated steam cracking at the four temperatures of 780, 800, 820 and 840° C. under the conditions summarised below to yield respective propylene/ethylene weight ratios of 2.031. 1.666, 1.332 and 1.036.

In Example 9, the simulated composition shown in Table 7 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.69 bara and a coil outlet pressure of 2.15 bara. The residence time was 483 milliseconds. The duty of the cracker was 6.0 megawatts. For an inlet flow rate of 14200 kg per hour, the effluent included 1714 kg per hour ethylene and 3481 kg per hour propylene, yielding a propylene/ethylene weight ratio of 2.031.

In Examples 10 to 12, the same simulated catalytically cracked raffinate 2 feedstock was similarly subjected to simulated steam cracking at coil outlet temperatures of 800, 820 and 840° C. respectively using a constant steam cracker feed rate (14.2 tonnes per hour).

In Example 10, the simulated conditions were modified to have a coil inlet pressure of 2.70 bara. The residence time was 469 milliseconds. The duty of the cracker was 6.8 megawatts. For an inlet flow rate of 14200 kg per hour, the effluent included 2059 kg per hour ethylene and 3430 kg per hour propylene, yielding a propylene/ethylene weight ratio of 1.666.

In Example 11, the simulated conditions were modified to have a coil inlet pressure of 2.72 bara. The residence time was 457 milliseconds. The duty of the cracker was 7.6 megawatts. For an inlet flow rate of 14200 kg per hour, the effluent included 2426 kg per hour ethylene and 3232 kg per hour propylene, yielding a propylene/ethylene weight ratio of 1.332.

In Example 12, the simulated conditions were modified to have a coil inlet pressure of 2.74 bara. The residence time was 446 milliseconds. The duty of the cracker was 8.3 megawatts. For an inlet flow rate of 14200 kg per hour, the effluent included 2790 kg per hour ethylene and 2890 kg per hour propylene, yielding a propylene/ethylene weight ratio of 1.036.

These Examples also showed reduced coking when the steam cracker was operated at low severity.

EXAMPLES 13 to 16

In these Examples, which are modifications to Examples 9 to 12, the simulated raffinate 2 was initially subjected to simulated olefinic catalytic cracking to produce the composition of Table 7 and then additionally subjected to simulated fractionation from the effluent of $C_3$ and $C_2$ in the effluent to produce the composition of Table 8 and then followed by simulated steam cracking under substantially the same conditions as for the corresponding Examples 9 to 12. The feed rate was 14.2 tonnes per hour for the steam cracker and an initial inlet feed rate for the olefinic catalytic cracker was 19192.9 kg/hour, since the $C_3/C_2$ overhead fraction from the fractionator bypassed the steam cracker.

For Example 13 the propylene/ethylene weight ratio was 2.831 for the composite effluent to be sent to the combined fractionator.

For Examples 14, 15 and 16, the corresponding propylene/ethylene weight ratios in the composite effluent were 2.518, 2.188, 1.880.

The total propylene/ethylene weight ratio results for each temperature are summarised in FIG. 3.

These Examples also showed reduced coking when the steam cracker was operated at low severity.

EXAMPLES 17 to 20

In these Examples, the simulated hydrotreated raw $C_4$ hydrocarbon feedstock of Comparative Examples 13 to 16 was initially subjected to a simulated olefin catalytic cracking process so as to produce a simulated effluent therefrom having the composition shown in Table 9. This effluent was then subjected to simulated steam cracking at the four temperatures of 780, 800, 820 and 840° C. under the conditions summarised below to yield respective propylene/ethylene weight ratios of 2.080, 1.671, 1.316 and 1.007.

In Example 17, the simulated composition shown in Table 9 was steam cracked in a steam cracker having a coil outlet temperature of 780° C., and an inlet radiation temperature of 535° C., a throughput of 14.2 tonnes per hour, a steam dilution of 0.35 kg of steam per kg of hydrogen feedstock, a coil inlet pressure of 2.68 bara and a coil outlet pressure of 2.15 bara. The residence time was 486 milliseconds. The duty of the cracker was 4.9 megawatts. For an inlet flow rate of 14200 kg per hour, the effluent included 17874 kg per hour ethylene and 3898 kg per hour propylene, yielding a propylene/ethylene weight ratio of 2.080.

In Examples 18 to 20, the same simulated catalytically cracked hydrotreated raw $C_4$ hydrocarbon feedstock was similarly subjected to simulated steam cracking at coil outlet temperatures of 800, 820 and 840° C. respectively using a constant steam cracker feed rate (14.2 tonnes per hour).

In Example 18, the simulated conditions were modified to have a coil inlet pressure of 2.69 bara. The residence time was 475 milliseconds. The duty of the cracker was 5.4 megawatts. For an inlet flow rate of 14200 kg per hour, the effluent included 2170 kg per hour ethylene and 3627 kg per hour propylene, yielding a propylene/ethylene weight ratio of 1.671.

In Example 19, the simulated conditions were modified to have a coil inlet pressure of 2.71 bara. The residence time was 466 milliseconds. The duty of the cracker was 5.9 megawatts. For an inlet flow rate of 14200 kg per hour, the effluent included 2478 kg per hour ethylene and 3260 kg per hour propylene, yielding a propylene/ethylene weight ratio of 1.316.

In Example 20, the simulated conditions were modified to have a coil inlet pressure of 2.72 bara. The residence time was 456 milliseconds. The duty of the cracker was 6.4 megawatts. For an inlet flow rate of 14200 kg per hour, the effluent included 2783 kg per hour ethylene and 2802 kg per hour propylene, yielding a propylene/ethylene weight ratio of 1.007.

These Examples also showed reduced coking when the steam cracker was operated at low severity.

EXAMPLES 21 to 24

In these Examples, which are modifications to Examples 17 to 20, the simulated hydrotreated raw $C_4$ hydrocarbon feedstock was initially subjected to simulated olefinic catalytic cracking to produce the composition of Table 9 and then additionally subjected to simulated fractionation from the effluent of $C_3$ and $C_2$ in the effluent to produce the composition of Table 10 and then followed by simulated steam cracking under substantially the same conditions as for the corresponding Examples 17 to 20. The feed rate was 14.2 tonnes per hour for the steam cracker and an initial inlet feed rate for the olefinic catalytic cracker was 22775 kg/hour, since the $C_3/C_2$ overhead fraction from the fractionator bypassed the steam cracker.

For Example 21 the propylene/ethylene weight ratio was 3.166 for the composite effluent to be sent to the combined fractionator.

For Examples 22, 23 and 24, the corresponding propylene/ethylene weight ratios in the composite effluent were 2.881, 2.614 and 2.356.

The total propylene/ethylene weight ratio results for each temperature are summarised in FIG. 3.

These Examples also showed reduced coking when the steam cracker was operated at low severity.

COMPARATIVE EXAMPLES 17 to 32

In these Comparative Examples, the straight run naphtha, LCCS, raffinate 2 and hydrotreated raw $C_4$ feedstocks employed in the earlier Comparative Examples were subjected to steam cracking at a coil outlet temperature of 780, 800, 820 and 840° C. with the steam cracker being operated not at constant steam cracker feed rate, as in the earlier Comparative Examples, but rather at constant steam cracker furnace duty. For the simulations, the furnace geometry was kept unchanged and the coil pressure drop increased accordingly, while the residence time decreased. The simulation therefore needs to be considered as "maximum" case and would be likely to require a modification, in known manner, of the furnace and coils assembly in an actual furnace. The results of the propylene/ethylene weight ratios for these Comparative Examples are summarised in FIG. 4.

EXAMPLES 25 to 40

For these Examples, the furnace was, like for Comparative Examples 17 to 32, operated at constant furnace duty and as for Examples 5 to 8, 13 to 16 and 21 to 24 an initial feedstock, comprising LCCS, raffinate 2 or hydrotreated raw $C_4$ respectively, was subjected to simulated catalytic cracking, fractionation to remove the $C_3/C_2$ overhead, then steam cracking, and then combination of the steam cracked effluent with the $C_2/C_3$ overhead, and with the steam cracking having been carried out at constant furnace duty at 780, 800, 820 or 840° C. The resultant total propylene/ethylene weight ratios for the combined effluent are summarised in FIG. 5.

EXAMPLES 41 and 42

In these examples, the conditions and feedstocks for the catalytic cracker were the same as for Examples 5 and 13 respectively, but the steam cracker was fed with the unfractionated effluent from the catalytic cracker and was also supplied with a straight run naphtha. The weight ratio of effluent from the catalytic cracker: straight run naphtha was 15:85 for each example. The composition of each composite feedstock for the steam cracker in each example is shown in Tables 11 and 12.

Using steam cracking conditions substantially the same as for the corresponding Examples 5 and 13 respectively, the propylene/ethylene weight ratio in the final effluent was 0.937 for Example 41 and 0.972 for Example 42. These values are higher than the corresponding values for Example 1 when just straight run naphtha was steam cracked. This shows that when a steam cracker is used to crack a straight run naphtha, in order to increase the production of propylene, and in particular, in order to increase the propylene/ethylene weight ratio in the effluent, a proportion of the naphtha feed may be replaced with an olefin containing feed such as the effluent from a catalytic cracker for cracking the olefins in a feedstock such as LCCS or raffinate 2. The composite feedstock for the steam cracker may comprise from 5 to 95 wt %, most typically about 15 wt % of the olefin containing feed and from 95 to 5 wt %, most typically about 85 wt % of the straight run naphtha feed.

EXAMPLES 43 to 48

For Examples 43, 44 and 45, Example 41 was repeated but at 800, 820 and 840° C. to yield propylene/ethylene weight ratios in the final effluent of 0.821, 0.707 and 0.594 respectively. For Examples 46, 47 and 48, Example 42 was repeated but at 800, 820 and 840° C. to yield propylene/ethylene weight ratios in the final effluent of 0.851, 0.733 and 0.616 respectively. Again, these values are higher than the corresponding values for Example 1 when just straight run naphtha was steam cracked.

It may be seen from a comparison of the Examples and Comparative Examples that the use of an olefin catalytic cracking process as a pre-treatment for a feedstock for a steam cracker for producing an olefin-containing effluent results in a greater propylene/ethylene weight ratio as compared to when just steam cracking the same feedstock, or steam cracking a straight run naphtha. Moreover, the propylene/ethylene weight ratio tends to be even more greatly increased when the lower olefins, comprising the $C_3/C_2$ overhead, is fractionated from the effluent of the olefin catalytic cracking process, and the $C_4$+ bottom fraction is fed into the steam cracker. Moreover, the steam cracker can additionally be fed with a straight run naphtha.

It may be seen additionally that when the steam cracker is run at low severity, at a coil outlet temperature of around 780° C., the propylene/ethylene weight ratio is high, and in addition these conditions mitigate the problem of coking of the steam cracker coils.

It is pointed out for the raffinate 2 results, the propylene/ethylene weight ratio tend to produce an exceptionally high propylene content as compared to the other feedstocks. It is believed, without being bound by theory, that these results result from a high isoparaffin content, and relatively low olefin content, in the raffinate 2 as compared to the other feedstocks, which tends highly to favour the production of propylene, rather than ethylene, during the steam cracking step.

TABLE 1

| NAPHTHA | | | | | |
|---|---|---|---|---|---|
| | NPAR | IPAR | NAP | ARO | TOTAL |
| 4 | 2.00 | 0.00 | 0.00 | 0.00 | 2.00 |
| 5 | 21.58 | 15.77 | 0.70 | 0.00 | 38.03 |
| 6 | 13.27 | 15.87 | 3.89 | 1.80 | 34.83 |
| 7 | 5.89 | 7.78 | 5.69 | 2.10 | 21.46 |
| 8 | 0.80 | 2.10 | 0.80 | 0.00 | 3.70 |
| 9 | 0.00 | 0.00 | 0.00 | 0.00 | 0.00 |

TABLE 1-continued

| NAPHTHA | | | | | |
|---|---|---|---|---|---|
| | NPAR | IPAR | NAP | ARO | TOTAL |
| 10 | 0.00 | 0.00 | 0.00 | 0.00 | 0.00 |
| 11 | 0.00 | 0.00 | 0.00 | 0.00 | 0.00 |
| 12 | 0.00 | 0.00 | 0.00 | 0.00 | 0.00 |
| TOTAL | 43.52 | 41.52 | 11.08 | 3.90 | 100.02 |
| | | | | | 100.02 |

TABLE 2

| LCCS FEED ARO RICH | | | | | | | |
|---|---|---|---|---|---|---|---|
| | NPAR | IPAR | NAP | ARO | OLEFINS | DIENES | TOTAL |
| 1 | 0.00 | 0.00 | 0.00 | 0.00 | 0.00 | 0.00 | 0.00 |
| 2 | 0.00 | 0.00 | 0.00 | 0.00 | 0.00 | 0.00 | 0.00 |
| 3 | 0.00 | 0.00 | 0.00 | 0.00 | 0.00 | 0.00 | 0.00 |
| 4 | 0.52 | 0.43 | 0.00 | 0.00 | 3.82 | 0.00 | 4.77 |
| 5 | 0.99 | 8.76 | 0.20 | 0.00 | 13.18 | 0.00 | 23.11 |
| 6 | 0.70 | 11.72 | 2.88 | 0.67 | 10.21 | 0.01 | 26.19 |
| 7 | 0.92 | 5.88 | 3.16 | 3.75 | 6.47 | 0.01 | 20.18 |
| 8 | 1.04 | 5.49 | 4.08 | 5.80 | 2.38 | 0.01 | 18.79 |
| 9 | 0.13 | 2.63 | 0.52 | 2.67 | 0.27 | 0.00 | 6.21 |
| 10 | 0.00 | 0.25 | 0.00 | 0.48 | 0.00 | 0.00 | 0.73 |
| 11 | 0.00 | 0.00 | 0.00 | 0.03 | 0.00 | 0.00 | 0.03 |
| 12 | 0.00 | 0.00 | 0.00 | 0.00 | 0.00 | 0.00 | 0.00 |
| TOTAL | 4.29 | 35.16 | 10.84 | 13.39 | 36.29 | 0.04 | 100.00 |
| | | | | | | | 100.00 |

TABLE 3

| RAF2 FEED | | | | | | | |
|---|---|---|---|---|---|---|---|
| | NPAR | IPAR | NAP | ARO | OLEFINS | DIENES | TOTAL |
| 1 | 0.00 | 0.00 | 0.00 | 0.00 | 0.00 | 0.00 | 0.00 |
| 2 | 0.00 | 0.00 | 0.00 | 0.00 | 0.00 | 0.00 | 0.00 |
| 3 | 0.49 | 0.00 | 0.00 | 0.00 | 0.20 | 0.01 | 0.70 |
| 4 | 12.99 | 31.93 | 0.00 | 0.00 | 53.80 | 0.12 | 98.84 |
| 5 | 0.00 | 0.29 | 0.00 | 0.00 | 0.16 | 0.00 | 0.45 |
| 6 | 0.00 | 0.00 | 0.00 | 0.00 | 0.00 | 0.00 | 0.00 |
| 7 | 0.00 | 0.00 | 0.00 | 0.00 | 0.00 | 0.00 | 0.00 |
| 8 | 0.00 | 0.00 | 0.00 | 0.00 | 0.00 | 0.00 | 0.00 |
| 9 | 0.00 | 0.00 | 0.00 | 0.00 | 0.00 | 0.00 | 0.00 |
| 10 | 0.00 | 0.00 | 0.00 | 0.00 | 0.00 | 0.00 | 0.00 |
| 11 | 0.00 | 0.00 | 0.00 | 0.00 | 0.00 | 0.00 | 0.00 |
| 12 | 0.00 | 0.00 | 0.00 | 0.00 | 0.00 | 0.00 | 0.00 |
| TOTAL | 13.49 | 32.22 | 0.00 | 0.00 | 54.16 | 0.13 | 100.00 |
| | | | | | | | 100.00 |

TABLE 4

| HT RAW C4 | | | | | | | |
|---|---|---|---|---|---|---|---|
| | NPAR | IPAR | NAP | ARO | OLEFINS | DIENES | TOTAL |
| 1 | 0.00 | 0.00 | 0.00 | 0.00 | 0.00 | 0.00 | 0.00 |
| 2 | 0.00 | 0.00 | 0.00 | 0.00 | 0.00 | 0.00 | 0.00 |
| 3 | 0.01 | 0.00 | 0.00 | 0.00 | 0.00 | 0.00 | 0.01 |
| 4 | 6.96 | 1.88 | 0.00 | 0.00 | 90.98 | 0.02 | 99.85 |
| 5 | 0.00 | 0.00 | 0.00 | 0.00 | 0.00 | 0.00 | 0.00 |
| 6 | 0.00 | 0.00 | 0.00 | 0.00 | 0.14 | 0.00 | 0.14 |
| 7 | 0.00 | 0.00 | 0.00 | 0.00 | 0.00 | 0.00 | 0.00 |
| 8 | 0.00 | 0.00 | 0.00 | 0.00 | 0.00 | 0.00 | 0.00 |
| 9 | | | | | | | 0.00 |

TABLE 4-continued

| HT RAW C4 | | | | | | | |
|---|---|---|---|---|---|---|---|
| | NPAR | IPAR | NAP | ARO | OLEFINS | DIENES | TOTAL |
| 10 | | | | | | | 0.00 |
| 11 | | | | | | | 0.00 |
| 12 | | | | | | | 0.00 |
| TOTAL | 6.97 | 1.89 | 0.00 | 0.00 | 91.12 | 0.03 | 100.00 |
| | | | | | | | 100.00 |

TABLE 5

| FBC EFFLUENT USING LCCS ARO RICH AS FEED | | | | | | | |
|---|---|---|---|---|---|---|---|
| | NPAR | IPAR | NAP | ARO | OLEFINS | DIENES | TOTAL |
| 1 | 0.29 | 0.00 | 0.00 | 0.00 | 0.00 | 0.00 | 0.29 |
| 2 | 0.14 | 0.00 | 0.00 | 0.00 | 2.94 | 0.00 | 3.08 |
| 3 | 0.73 | 0.00 | 0.00 | 0.00 | 12.07 | 0.00 | 12.80 |
| 4 | 0.81 | 0.80 | 0.00 | 0.00 | 11.01 | 0.00 | 12.61 |
| 5 | 1.07 | 8.73 | 0.37 | 0.00 | 5.82 | 0.15 | 16.14 |
| 6 | 0.84 | 13.03 | 2.26 | 0.61 | 2.14 | 0.07 | 18.76 |
| 7 | 0.52 | 4.80 | 3.40 | 5.24 | 1.25 | 0.01 | 15.22 |
| 8 | 0.73 | 4.37 | 2.45 | 4.51 | 1.15 | 0.00 | 13.20 |
| 9 | 0.10 | 2.52 | 0.24 | 3.08 | 0.42 | 0.00 | 6.36 |
| 10 | 0.02 | 0.48 | 0.04 | 0.81 | 0.00 | 0.00 | 1.36 |
| 11 | 0.00 | 0.00 | 0.00 | 0.10 | 0.00 | 0.00 | 0.10 |
| 12 | 0.01 | 0.00 | 0.00 | 0.03 | 0.00 | 0.00 | 0.04 |
| 13 | 0.03 | 0.00 | 0.00 | 0.00 | 0.00 | 0.00 | 0.03 |
| TOTAL | 5.08 | 34.73 | 8.76 | 14.38 | 36.81 | 0.23 | 100.00 |
| | | | | | | | 100.00 |

TABLE 6

| FBC EFFLUENT USING LCCS ARO RICH AS FEED + C4 + SPLIT | | | | | | | |
|---|---|---|---|---|---|---|---|
| | NPAR | IPAR | NAP | ARO | OLEFINS | DIENES | TOTAL |
| 1 | 0.00 | 0.00 | 0.00 | 0.00 | 0.00 | 0.00 | 0.00 |
| 2 | 0.00 | 0.00 | 0.00 | 0.00 | 0.00 | 0.00 | 0.00 |
| 3 | 0.00 | 0.00 | 0.00 | 0.00 | 0.00 | 0.00 | 0.00 |
| 4 | 0.96 | 0.95 | 0.00 | 0.00 | 13.13 | 0.00 | 15.04 |
| 5 | 1.28 | 10.42 | 0.44 | 0.00 | 6.94 | 0.18 | 19.26 |
| 6 | 0.78 | 15.55 | 2.70 | 0.73 | 2.56 | 0.09 | 22.38 |
| 7 | 0.82 | 5.72 | 4.08 | 6.25 | 1.50 | 0.01 | 18.15 |
| 8 | 0.87 | 5.21 | 2.92 | 5.38 | 1.37 | 0.00 | 15.75 |
| 9 | 0.11 | 3.01 | 0.28 | 3.68 | 0.51 | 0.00 | 7.58 |
| 10 | 0.03 | 0.58 | 0.05 | 0.97 | 0.00 | 0.00 | 1.62 |
| 11 | 0.00 | 0.00 | 0.00 | 0.12 | 0.00 | 0.00 | 0.12 |
| 12 | 0.01 | 0.00 | 0.00 | 0.03 | 0.00 | 0.00 | 0.04 |
| 13 | 0.04 | 0.00 | 0.00 | 0.00 | 0.00 | 0.00 | 0.04 |
| TOTAL | 4.68 | 41.43 | 10.45 | 17.15 | 26.00 | 0.28 | 100.00 |
| | | | | | | | 100.00 |
| | | | | | | | 83.83 |

TABLE 7

| FBC EFFLUENT USING RAF2 AS FEED | | | | | | | |
|---|---|---|---|---|---|---|---|
| | NPAR | IPAR | NAP | ARO | OLEFINS | DIENES | TOTAL |
| 1 | 0.30 | 0.00 | 0.00 | 0.00 | 0.00 | 0.00 | 0.30 |
| 2 | 0.16 | 0.00 | 0.00 | 0.00 | 5.12 | 0.00 | 5.28 |
| 3 | 1.41 | 0.00 | 0.00 | 0.00 | 19.01 | 0.00 | 20.43 |
| 4 | 13.87 | 31.96 | 0.00 | 0.00 | 15.72 | 0.11 | 61.66 |
| 5 | 0.17 | 0.53 | 0.35 | 0.00 | 5.30 | 0.15 | 6.49 |
| 6 | 0.06 | 0.03 | 0.32 | 0.55 | 2.15 | 0.00 | 3.09 |
| 7 | 0.01 | 0.06 | 0.18 | 0.91 | 0.63 | 0.00 | 1.78 |
| 8 | 0.00 | 0.08 | 0.02 | 0.86 | 0.00 | 0.00 | 0.96 |
| 9 | 0.00 | 0.00 | 0.00 | 0.00 | 0.00 | 0.00 | 0.00 |

TABLE 7-continued

| FBC EFFLUENT USING RAF2 AS FEED | | | | | | | |
|---|---|---|---|---|---|---|---|
| | NPAR | IPAR | NAP | ARO | OLEFINS | DIENES | TOTAL |
| 10 | 0.00 | 0.00 | 0.00 | 0.00 | 0.00 | 0.00 | 0.00 |
| 11 | 0.00 | 0.00 | 0.00 | 0.00 | 0.00 | 0.00 | 0.00 |
| 12 | 0.00 | 0.00 | 0.00 | 0.00 | 0.00 | 0.00 | 0.00 |
| 13 | 0.00 | 0.00 | 0.00 | 0.00 | 0.00 | 0.00 | 0.00 |
| TOTAL | 15.97 | 32.66 | 0.86 | 2.31 | 47.93 | 0.26 | 100.00 |
| | | | | | | | 100.00 |

TABLE 8

| FBC EFFLUENT USING RAF2 AS FEED + C4 + SPLITTER | | | | | | | |
|---|---|---|---|---|---|---|---|
| | NPAR | IPAR | NAP | ARO | OLEFINS | DIENES | TOTAL |
| 1 | 0.00 | 0.00 | 0.00 | 0.00 | 0.00 | 0.00 | 0.00 |
| 2 | 0.00 | 0.00 | 0.00 | 0.00 | 0.00 | 0.00 | 0.00 |
| 3 | 0.00 | 0.00 | 0.00 | 0.00 | 0.00 | 0.00 | 0.00 |
| 4 | 18.75 | 43.20 | 0.00 | 0.00 | 21.25 | 0.15 | 83.35 |
| 5 | 0.22 | 0.71 | 0.47 | 0.00 | 7.16 | 0.20 | 8.77 |
| 6 | 0.07 | 0.04 | 0.43 | 0.74 | 2.90 | 0.00 | 4.18 |
| 7 | 0.01 | 0.08 | 0.24 | 1.22 | 0.85 | 0.00 | 2.41 |
| 8 | 0.00 | 0.11 | 0.02 | 1.16 | 0.00 | 0.00 | 1.30 |
| 9 | 0.00 | 0.00 | 0.00 | 0.00 | 0.00 | 0.00 | 0.00 |
| 10 | 0.00 | 0.00 | 0.00 | 0.00 | 0.00 | 0.00 | 0.00 |
| 11 | 0.00 | 0.00 | 0.00 | 0.00 | 0.00 | 0.00 | 0.00 |
| 12 | 0.00 | 0.00 | 0.00 | 0.00 | 0.00 | 0.00 | 0.00 |
| 13 | 0.00 | 0.00 | 0.00 | 0.00 | 0.00 | 0.00 | 0.00 |
| TOTAL | 19.05 | 44.14 | 1.17 | 3.12 | 32.16 | 0.35 | 100.00 |
| | | | | | | | 100.00 |
| | | | | | | | 73.99 |

TABLE 9

| FBC EFFLUENT USING HT RAW C4 AS FEED | | | | | | | |
|---|---|---|---|---|---|---|---|
| | NPAR | IPAR | NAP | ARO | OLEFINS | DIENES | TOTAL |
| 1 | 0.32 | 0.00 | 0.00 | 0.00 | 0.00 | 0.00 | 0.32 |
| 2 | 0.28 | 0.00 | 0.00 | 0.00 | 6.49 | 0.00 | 6.76 |
| 3 | 0.92 | 0.00 | 0.00 | 0.00 | 29.65 | 0.00 | 30.57 |
| 4 | 8.29 | 3.65 | 0.00 | 0.00 | 28.80 | 0.08 | 40.83 |
| 5 | 0.19 | 0.37 | 0.46 | 0.00 | 10.56 | 0.28 | 11.86 |
| 6 | 0.09 | 0.04 | 0.39 | 0.99 | 4.09 | 0.00 | 5.61 |
| 7 | 0.00 | 0.13 | 0.25 | 1.15 | 1.13 | 0.00 | 2.67 |
| 8 | 0.00 | 0.19 | 0.03 | 1.16 | 0.00 | 0.00 | 1.38 |
| 9 | | | | | | | 0.00 |
| 10 | | | | | | | 0.00 |
| 11 | | | | | | | 0.00 |
| 12 | | | | | | | 0.00 |
| 13 | | | | | | | 0.00 |
| TOTAL | 10.09 | 4.38 | 1.14 | 3.30 | 80.72 | 0.37 | 100.00 |
| | | | | | | | 100.00 |

TABLE 10

| FBC EFFLUENT USING HT RAW C4 AS FEED + C4 + SPLITTER | | | | | | | |
|---|---|---|---|---|---|---|---|
| | NPAR | IPAR | NAP | ARO | OLEFINS | DIENES | TOTAL |
| 1 | | | | | | | 0.00 |
| 2 | | | | | | | 0.00 |
| 3 | | | | | | | 0.00 |
| 4 | 13.30 | 5.85 | 0.00 | 0.00 | 46.19 | 0.14 | 65.48 |
| 5 | 0.31 | 0.59 | 0.74 | 0.00 | 16.94 | 0.45 | 19.03 |
| 6 | 0.15 | 0.06 | 0.63 | 1.59 | 6.56 | 0.00 | 8.99 |
| 7 | 0.01 | 0.21 | 0.40 | 1.85 | 1.81 | 0.00 | 4.28 |
| 8 | 0.00 | 0.31 | 0.05 | 1.86 | 0.00 | 0.00 | 2.22 |

TABLE 10-continued

| FBC EFFLUENT USING HT RAW C4 AS FEED + C4 + SPLITTER | | | | | | | |
|---|---|---|---|---|---|---|---|
| | NPAR | IPAR | NAP | ARO | OLEFINS | DIENES | TOTAL |
| 9 | | | | | | | 0.00 |
| 10 | | | | | | | 0.00 |
| 11 | | | | | | | 0.00 |
| 12 | | | | | | | 0.00 |
| 13 | | | | | | | 0.00 |
| TOTAL | 13.77 | 7.02 | 1.82 | 5.30 | 71.50 | 0.59 | 100.00 |
| | | | | | | | 100.00 |
| | | | | | | | 62.35 |

TABLE 11

| COCRACKING OF 15 WT % FBC EFFLUENT USING LCCS ARO RICH AS FEED AND 85 WT % NAPHTHA | | | | | | | |
|---|---|---|---|---|---|---|---|
| | NPAR | IPAR | NAP | ARO | OLEFINS | DIENES | TOTAL |
| 1 | 0.04 | 0.00 | 0.00 | 0.00 | 0.00 | 0.00 | 0.04 |
| 2 | 0.02 | 0.00 | 0.00 | 0.00 | 0.44 | 0.00 | 0.46 |
| 3 | 0.11 | 0.00 | 0.00 | 0.00 | 1.81 | 0.00 | 1.92 |
| 4 | 1.82 | 0.12 | 0.00 | 0.00 | 1.65 | 0.00 | 3.59 |
| 5 | 18.49 | 14.71 | 0.65 | 0.00 | 0.87 | 0.02 | 34.75 |
| 6 | 11.38 | 15.44 | 3.65 | 1.62 | 0.32 | 0.01 | 32.42 |
| 7 | 5.08 | 7.33 | 5.35 | 2.57 | 0.19 | 0.00 | 20.52 |
| 8 | 0.79 | 2.44 | 1.05 | 0.68 | 0.17 | 0.00 | 5.13 |
| 9 | 0.01 | 0.38 | 0.04 | 0.46 | 0.06 | 0.00 | 0.95 |
| 10 | 0.00 | 0.07 | 0.01 | 0.12 | 0.00 | 0.00 | 0.20 |
| 11 | 0.00 | 0.00 | 0.00 | 0.01 | 0.00 | 0.00 | 0.01 |
| 12 | 0.00 | 0.00 | 0.00 | 0.00 | 0.00 | 0.00 | 0.01 |
| 13 | 0.00 | 0.00 | 0.00 | 0.00 | 0.00 | 0.00 | 0.00 |
| TOTAL | 37.75 | 40.50 | 10.73 | 5.47 | 5.52 | 0.03 | 100.02 |
| | | | | | | | 100.02 |

TABLE 12

| COCRACKING OF 15 WT % FBC EFFLUENT USING RAF2 AS FEED AND 85 WT % NAPHTHA | | | | | | | |
|---|---|---|---|---|---|---|---|
| | NPAR | IPAR | NAP | ARO | OLEFINS | DIENES | TOTAL |
| 1 | 0.05 | 0.00 | 0.00 | 0.00 | 0.00 | 0.00 | 0.05 |
| 2 | 0.02 | 0.00 | 0.00 | 0.00 | 0.77 | 0.00 | 0.79 |
| 3 | 0.21 | 0.00 | 0.00 | 0.00 | 2.85 | 0.00 | 3.06 |
| 4 | 3.78 | 4.79 | 0.00 | 0.00 | 2.36 | 0.02 | 10.95 |
| 5 | 18.35 | 13.48 | 0.65 | 0.00 | 0.79 | 0.02 | 33.30 |
| 6 | 11.29 | 13.49 | 3.35 | 1.61 | 0.32 | 0.00 | 30.07 |
| 7 | 5.01 | 6.62 | 4.86 | 1.92 | 0.09 | 0.00 | 18.51 |
| 8 | 0.68 | 1.80 | 0.68 | 0.13 | 0.00 | 0.00 | 3.29 |
| 9 | 0.00 | 0.00 | 0.00 | 0.00 | 0.00 | 0.00 | 0.00 |
| 10 | 0.00 | 0.00 | 0.00 | 0.00 | 0.00 | 0.00 | 0.00 |
| 11 | 0.00 | 0.00 | 0.00 | 0.00 | 0.00 | 0.00 | 0.00 |
| 12 | 0.00 | 0.00 | 0.00 | 0.00 | 0.00 | 0.00 | 0.00 |
| 13 | 0.00 | 0.00 | 0.00 | 0.00 | 0.00 | 0.00 | 0.00 |
| TOTAL | 39.39 | 40.19 | 9.55 | 3.66 | 7.19 | 0.04 | 100.02 |
| | | | | | | | 100.02 |

The invention claimed is:

1. A process for the conversion of an olefin feedstock comprising cracking said olefin feedstock over a crystalline silicate catalyst to produce a cracked effluent, fractionating said cracked effluent to produce a relatively light overheads fraction and a relatively heavy bottoms fraction, steam-cracking said bottoms fraction to produce a steam-cracked effluent, and conducting common fractionation of a mixture of said steam-cracked effluent and said relatively light overheads fraction to produce a common fractionation product.

2. The process of claim 1 further comprising cracking a paraffin feedstock to produce a second steam-cracked effluent which is combined with said first recited steam-cracked effluent and said relatively light overheads fraction in said common fractionation procedure.

3. The process of claim 2 wherein said relatively heavy bottoms fraction and said paraffinic feedstock are steam cracked at different severities.

4. The process of claim 3 wherein said relatively heavy bottoms fraction is steam cracked at a lower temperature severity than said paraffinic feedstock.

5. A process for steam cracking a hydrocarbon feedstock containing olefins to provide a steam-cracked effluent having an increased light olefin content, the process comprising steam cracking a paraffinic hydrocarbon feedstock comprising a paraffinic hydrocarbon feedstock and steam cracking another hydrocarbon feedstock which contains C.sub.4 and higher hydrocarbons and one or more olefins which comprises a bottom fraction of an intermediate effluent produced by catalytic cracking of an olefinic hydrocarbon feedstock in a reactor containing a crystalline silicate to produce the intermediate effluent having an olefin content of lower molecular weight than that of the olefinic feedstock, and combining the two steam cracked products from the paraffinic feedstock and said another hydrocarbon feedstock to provide a common effluent.

6. The process of claim 5 wherein said olefinic feedstock comprises at least one of a hydrotreated raw $C_4$ feedstock, LCCS, a raffinate 2 feedstock, a raffinate 1 feedstock, a raffinate 2 feedstock from a methyl tert-butyl ether (MTBE) or an ethyl tert-butyl ether (ETBE) unit, a raffinate from an olefins metathesis unit for the production of propylene from ethylene and butene, and a hydrotreated olefin-containing stream from an FCC unit, a visbreaker or a delayed coker.

7. The process of claim 5 wherein the common effluent and a top fraction of the intermediate effluent which contains $C_3$ and lower hydrocarbons are combined and the combined stream is subjected to combined fractionation.

8. The process of claim 5 wherein the paraffinic hydrocarbon feedstock is a $C_5$ to $C_9$ naphtha containing straight chain and/or isoparaffins.

9. The process of claim 5 wherein the crystalline silicate is selected from an MFI-type crystalline silicate having a silicon/aluminum atomic ratio of at least 180 and an MEL-type crystalline silicate having a silicon/aluminum atomic ratio of from 150 to 800 which has been subjected to a steaming step.

10. The process of claim 5 wherein the steam cracking of said another hydrocarbon feedstock is carried out in a steam cracker at an outlet coil temperature of from 760 to 860° C.

11. The process of claim 5 wherein the common effluent comprises from 5 to 95 wt. % of said paraffinic hydrocarbon feedstock and from 95 to 5 wt. % of said another hydrocarbon feedstock.

12. The process of claim 5 wherein said paraffinic hydrocarbon feedstock and said another hydrocarbon feedstock are steam cracked in respective furnaces of a common steam cracker at different severities.

* * * * *